US007957941B2

(12) United States Patent
Froyland et al.

(10) Patent No.: US 7,957,941 B2
(45) Date of Patent: Jun. 7, 2011

(54) SYSTEM AND METHOD(S) OF MINE PLANNING, DESIGN AND PROCESSING

(75) Inventors: Gary Allan Froyland, Kensington (AU); Merab Menabde, Cheltenham (AU)

(73) Assignee: BHP Billiton Innovation Pty. Ltd. (AU)

( * ) Notice: Subject to any disclaimer, the term of this patent is extended or adjusted under 35 U.S.C. 154(b) by 310 days.

(21) Appl. No.: 12/417,483

(22) Filed: Apr. 2, 2009

(65) Prior Publication Data

US 2009/0306942 A1 Dec. 10, 2009

Related U.S. Application Data

(63) Continuation of application No. 10/530,845, filed as application No. PCT/AU03/01298 on Oct. 2, 2003, now Pat. No. 7,519,515.

(30) Foreign Application Priority Data

| | | |
|---|---|---|
| Oct. 9, 2002 | (AU) | 2002951891 |
| Oct. 9, 2002 | (AU) | 2002951893 |
| Oct. 9, 2002 | (AU) | 2002951894 |
| Oct. 9, 2002 | (AU) | 2002951896 |
| Mar. 5, 2003 | (AU) | 2003901021 |

(51) Int. Cl.
*G06F 17/50* (2006.01)

(52) U.S. Cl. ..... 703/1; 299/19; 703/6

(58) Field of Classification Search ..... 703/1, 2
See application file for complete search history.

(56) References Cited

OTHER PUBLICATIONS

Tolwinski et al, "Long Term Open Pit Scheduler", Mine Planning and Equipment Selection, Singhal et al (eds), 1995, pp. 256-270.*

Kawalec et al, "Open Pit-Design Optimisation of a Lignite Deposit", Mine Planning and Equipment Selection, Panagiotou & Michalakopoulos (eds), 2000, pp. 217-222.*

Dagdelen, K., "Open Pit Optimization-Strategies for Improving Economics of Mining Projects Through Mine Planning", 17th International Mining Congress and Exhibition of Turkey, 2001, pp. 117-121.*

Bezdek, James C. et al., "Convergence Theory for Fuzzy c-Means: Counterexamples and Repairs", *IEEE Transactions on Systems, Man, and Cybernetics*, vol. SMC-17, No. 5 pp. 873-877, Sep./Oct. 1987.

Brealey, S.C. et al., "Opencast Mining", *The Mining Engineer, I.M.E.* (UK), No. 99, pp. 147-163, Dec. 1968.

Caccetta, Louis et al., "An Application of Branch and Cut to Open Pit Mine Scheduling", http://ructor.rutgers.edu/~do99/EA/SHill.doc, pp. 1-24, 1999.

International Search Report for PCT/AU03/01298, dated Nov. 3, 2003.

International Search Report for PCTAU03/01299, dated Nov. 11, 2003.

(Continued)

*Primary Examiner* — Mary C Jacob

(74) *Attorney, Agent, or Firm* — Brinks Hofer Gilson & Lione; G. Peter Nichols

(57) ABSTRACT

The present invention relates to the field of extracting resource(s) from a particular location. In particular, the present invention relates to the planning, design and processing related to a mine location in a manner based on enhancing the extraction of material considered of value, relative to the effort and/or time in extracting that material. The present application discloses, amongst other things, a method of and apparatus for determining slope constraints, determining a cluster of material, determining characteristics of a selected portion of material, analysing a selected volume of material, propagating clusters, forming clusters, mine design, aggregation of blocks into collections or clusters, splitting of waste and ore in clumps, determining a selected group of blocks to be mined, clump ordering and identifying clusters for push-back design.

39 Claims, 10 Drawing Sheets

OTHER PUBLICATIONS

Kaas, L. Michael, "Computer Techniques for Production Scheduling and Blending of Taconite" *Proceedings of the 26th Annual Mining Symposium*, University of Minnesota, pp. 135-144, Jan. 1965.

Lerchs, Helmut et al., Optimum Design of Open-Pit Mines, *Transactions, C.I.M.*, vol. LXVII, pp. 17-24, 1965.

Pana, M.T., "The Simulation Approach to Open-Pit Design", *Transactions of the Short Course and Symposium on Computers and Computer Applications in Mining and Exploration*, University of Arizona, pp. 1-24, Mar. 1965.

Underwood, R. et al., "A Mathematical Programming Viewpoint for Solving the Ultimate Pit Problem", *EJOR*, vol. 107 pp. 96-107, 1998.

Wharton, Christopher et al., "The Effect of Mining Width on NPV", *Proceedings of the 1997 Whittle Conference "Optimizing with Whittle"*, Perth, Western Australia, pp. 174-178, Apr. 1997.

Hochbaum et al., "Performance Analysis and Best Implementations of Old and New Algorithms for the Open-Pit Mining Problem", Department of Industrial Engineering and Operations Research, University of California, Berkley, Jan. 16, 1998.

Gershon, Mark, "Heuristic Approaches for Mine Planning and Production Scheduling", International Journal of Mining and Geological Engineering, 1987, 5, pp. 1-13.

Jain et al., "Data Clustering: A Review", ACM Computing Surveys, vol. 31, No. 3, Sep. 1999.

* cited by examiner

Figure 3
prior art
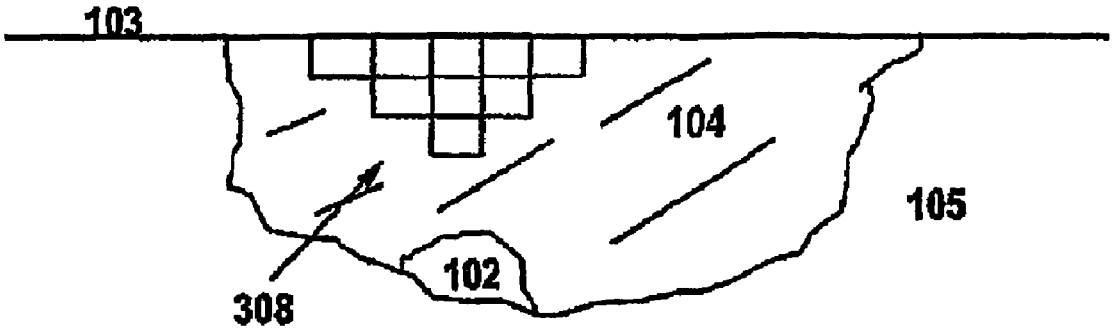
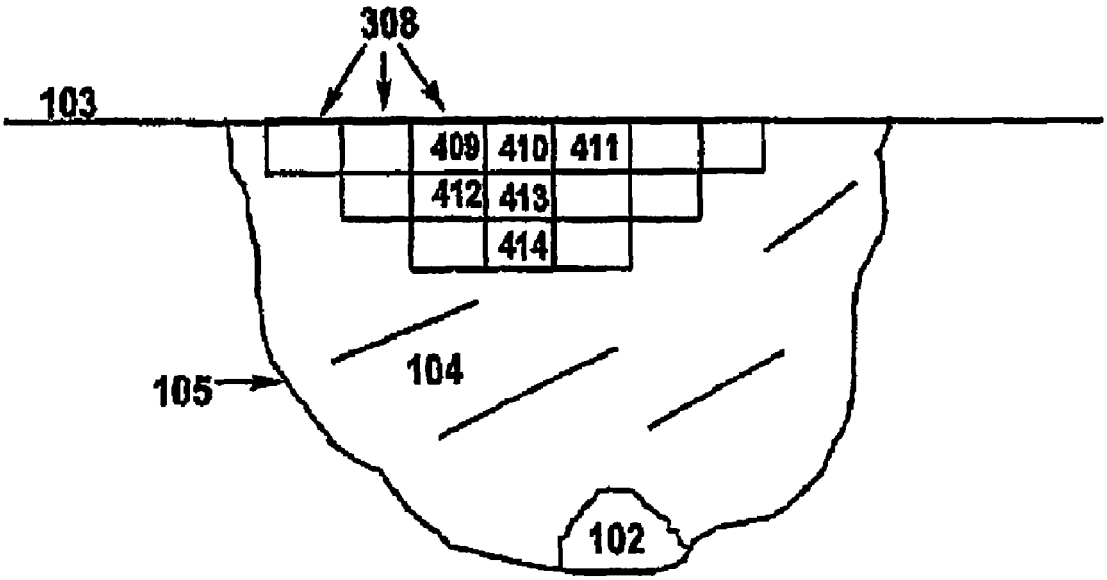
Figure 4
prior art

Figure 6 KlumpKing Top-Level Flow Chart

Plan view : 2D block slice
| | | | | |
|---|---|---|---|---|
| 1 | 8 | 13 | 2 | 3 |
| 11 | 9 | 14 | 4 | 6 |
| 10 | 12 | 15 | 7 | 5 |
Figure 11a
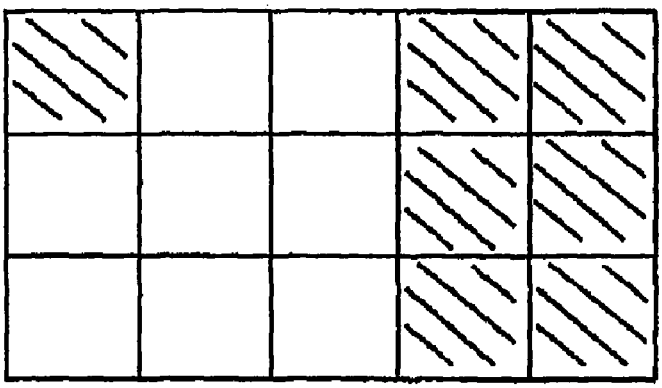
Figure 11b
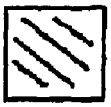
= cluster #1
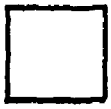
= cluster #2
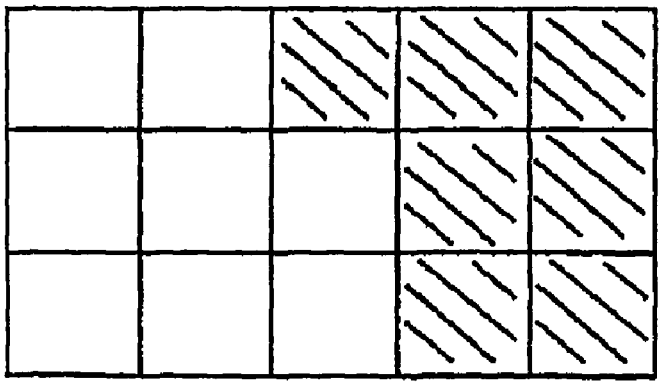
Figure 11c
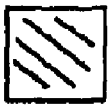
= cluster #1
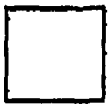
= cluster #2

View from above identifying blocks included in the true ultimate pit but omitted by the LP relaxation of the aggregated formulation Vertical cross-section of the exact ultimate pit found for first mine example Vertical cross-section of the ultimate pit found using the LP relaxation of the aggregared formualtion of the first mine example Example of feasible solution for LP relaxation of aggregared formulation that is infeasible for the exact formulation Vertical cross-section of the exact ultimate pit found for the third mine example Vertical cross-section of the ultimate pit found using the LP relaxation of the aggregated formulation for the third mine example Vertical cross-section of the exact utlimate pit found for the thrid mine example Vertical cross-section of the ultimate pit found using the LP relaxation of the aggregated formulation for the third mind example

SYSTEM AND METHOD(S) OF MINE PLANNING, DESIGN AND PROCESSING

The present application is a continuation of Ser. No. 10/530,845, now U.S. Pat. No. 7,519,515, the entire contents of which are incorporated herein by reference which claims priority to PCT/AU2003/001298 filed Oct. 2, 2003 and published in English on Apr. 22, 2004 as PCT WO2004/033853.

FIELD OF INVENTION

The present invention relates to the field of extracting resource(s) from a particular location. In particular, the present invention relates to the planning, design and processing related to a mine location in a manner based on enhancing the extraction of material considered of value, relative to the effort and/or time in extracting that material.

BACKGROUND ART

In the mining industry, once material of value, such as ore situated below the surface of the ground, has been discovered, there exists a need to extract that material from the ground.

In the past, one more traditional method has been to use a relatively large open cut mining technique, whereby a great volume of waste material is removed from the mine site in order for the miners to reach the material considered of value. For example, referring to FIG. 1, the mine 101 is shown with its valuable material 102 situated at a distance below the ground surface 103. In the past, most of the (waste) material 104 had to be removed so that the valuable material 102 could be exposed and extracted from the mine 101. In the past, this waste material was removed in a series of progressive layers 105, which are ever diminishing in area, until the valuable material 102 was exposed for extraction. This is not considered to be an efficient mining process, as a great deal of waste material must be removed, stored and returned at a later time to the mine site 101, in order to extract the valuable material 102. It is desirable to reduce the volume of waste material that must be removed prior to extracting the valuable material.

The open cut method exemplified in FIG. 1 is viewed as particularly inefficient where the valuable resource is located to one side of the pit 105 of a desirable mine site 101. For example, FIG. 2 illustrates such a situation. The valuable material 102 is located to one side of the pit 105. In such a situation, it is not considered efficient to remove the waste material 104 from region 206, that is where the waste material is not located relatively close to the valuable material 102, but it is considered desirable to remove the waste material 104 from region 207, that is where it is located nearer to the valuable material 102. This then rings other considerations to the fore. For example, it would be desirable to determine the boundary between regions 206 and 207, so that not too much undesirable waste material is removed (region 206), yet enough is removed to ensure safety factors are considered, such as cave-ins, etc. This then leads to a further consideration of the need to design a 'pit' 105 with a relatively optimal design having consideration for the location of the valuable material, relative to the waste material and other issues, such as safety factors.

This further consideration has led to an analysis of pit design, and a technique of removing waste material and valuable material called 'pushbacks'. This technique is illustrated in FIG. 3. Basically, the pit 105 is designed to an extent that the waste material 104 to be removed is minimised, but still enabling extraction of the valuable material 102. The technique uses 'blocks' 308 which represent smaller volumes of material. The area proximate the valuable material is divided into a number of blocks 308. It is then a matter of determining which blocks need to be removed in order to enable access to the valuable material 102. This determination of blocks 308', then gives rise to the design or extent of the pit 105.

FIG. 3 represents the mine as a two dimensional area, however, it should be appreciated that the mine is a three dimensional area. Thus the blocks 308 to be removed are determined in phases, and cones, which represent more accurately a three dimensional 'volume' which volume will ultimately form the pit 105.

Further consideration can be given to the prior art situation illustrated in FIG. 3. Consideration should be given to the scheduling of the removal of blocks. In effect, what is the best order of block removal, when other business aspects such as time/value and discounted cash flows are taken into account? There is a need to find a relatively optimal order of block removal which gives a relatively maximum value for a relatively minimum effort/time.

Attempts have been made in the past to find this 'optimum' block order by determining which block(s) 308 should be removed relative to a 'violation free' order. Turning to the illustration in FIG. 4, a pit 105 is shown with valuable material 102. For the purposes of discussion, if it was desirable to remove block 414, then there is considered to be a 'violation' if we determined a schedule of block removal which started by removing block 414 or blocks 414, 412 & 413 before blocks 409, 410 and 411 were removed. In other words, a violation free schedule would seek to remove other blocks 409, 410, 411, 412 and 413 before block 414. (It is important to note that the block number does not necessarily indicate a preferential order of block removal).

It can also be seen that this block scheduling can be extended to the entire pit 105 in order to remove the waste material 104 and the valuable material 102. With this violation free order schedule in mind, prior art attempts have been made. FIG. 5 illustrates one such attempt. Taking the blocks of FIG. 4, the blocks are numbered and sorted according to a 'mineable block order' having regard to practical mining techniques and other mine factors, such as safety etc and is illustrated by table 515. The blocks in table 515 are then sorted 516 with regard to Net Present Value (NPV) and is based on push back design via Life-of-mine NPV sequencing, taking into account obtaining the most value block from the ground at the earliest time. To illustrate the NPV sorting, and turning again to FIG. 4, there is a question as which of blocks 409, 410 or 411 should be removed first. All three blocks can be removed from the point of view of the ability to mine them, but it may, for example, be more economic to remove block 410, before block 409. Removing blocks 409, 410 or 411 does not lead to 'violations' thus consideration can be given to the order of block removal which is more economic.

The NPV sorting is conducted in a manner which does not lead to violations of the 'violation free order', and provides a table 517 listing an 'executable block order'. In other words, this prior art technique leads to a listing of blocks, in an order which determines their removal having regard to the ability to mine them, and the economic return for doing so.

Furthermore, a number of prior art techniques are considered to take a relatively simple view of the problems confronted by the mine designer in a 'real world' mine situation. For example, the size, complexity, nature of blocks, grade, slope and other engineering constraints and time taken to undertake a mining operation is often not fully taken into account in prior art techniques, leading to computational problems or errors in the mine design. Such errors can have significant financial and safety implications for the mine operator.

With regard to size, for example, prior art techniques fail to adequately take account of the size of a 'block'. Depending on the size of the overall project, a 'block' may be quite large, taking some weeks, months or even years to mine. If this is the case, many assumptions made in prior art techniques fail to give sufficient accuracy for the modern day business environment.

Given that many of the mine designs are mathematically and computational complex, according to prior art techniques, if the size of the blocks were reduced for greater accuracy, the result will be that either the optimisation techniques used will be time in feasible (that is they will take an inordinately long time to complete), or other assumptions will have to be made concerning aspects of the mine design such as mining rates, processing rates, etc which will result in a decrease the accuracy of the mine design solution.

Some examples of commercial software do use mixed integer programming engines, however, the method of aggregating blocks requires further improvement. For example, it is considered that product 'ECSI Maximiser' by ECS International Pty Ltd uses a form of integer optimisation in their pushback design, but the optimisation is local in time, and it's problem formulation is considered too large to optimise globally over the life of a mine. Also the product 'MineMax' by MineMAX Ptd Ltd may be used to find a rudimentary optimal block sequencing with a mixed integer programming engine, however it is considered that it's method of aggregation does not respect slopes as is required in many situations. 'MineMax' also optimises locally in time, and not globally. Thus, where there are a large number of variables, the user must resort to subdividing the pit into separate sections, and perform separate optimisations on each section, and thus the optimisation is not global over the entire pit. It is considered desirable to have an optimisation that is global in both space and time.

Dynamic Programming Approach

The Lerchs-Grossman graph-theoretic algorithm (H. Lerchs & I. Grossman, "Optimum Design of Open-Pit Mines", Transactions CIM, 1965) has been proved to give a relatively exact solution to the ultimate pit problem for an open-cut mine in three dimensions. Lerchs and Grossman also presents a dynamic programming approach to the problem in two dimensions, which has since been extended to three dimensions. However, solution of the three-dimensional graph theoretic algorithm is computationally inefficient in practical cases.

Linear Programming Approach

There is a linear program (LP), as presented by Underwood and Tolwinski (R. Underwood & B. Tolwinski, "A mathematical programming viewpoint for solving the ultimate pit problem", EJOR, 1998). The availability of CPLEX (by Ilog, www.ilog.com) as a powerful LP solver motivates investigation of the LP approach to the ultimate pit problem.

The ultimate pit problem can be modelled as an integer program (IP), where a value of 1 is assigned to blocks included in the ultimate pit, and a value of 0 is assigned otherwise. The IP formulation for the problem is then as follows.

Let equation 1

$$xi = \begin{cases} 1, & \text{if block } i \text{ is included in the ultimate pit} \\ 0, & \text{otherwise} \end{cases}$$

Then $$\max \sum_i v_i x_i$$

s.t.

$$x_i \le x_j \quad \forall\, j \in P(i)$$
$$x_i \in \{0, 1\} \quad \forall\, i$$

where vi is the value assigned to block i xi is the decision variable that designates whether block i is included in the ultimate pit or not P(i) is the set of predecessor blocks of block i.

One objective is to maximise the net value of the material removed from the pit. Consider that the only constraints are precedence constraints, which enforce the requirement of safe wall slopes in the mine. In fact, this IP formulation has the property of total unimodularity. That is, the solution of the LP relaxation of this formulation will be integral (i.e. a set of 0's and 1's). This is an extremely desirable property for an integer program. It allows the IP to be solved as an LP using the Simplex method. This leads to greatly increased solution efficiency in terms of both CPU time and memory requirements. The exact mathematical formulation of the linear programming approach to the ultimate pit problem is therefore $$\max \sum_i v_i x_i \qquad \text{equation 2}$$

s.t.

$$x_i \le x_j \quad \forall\, j \in P(i)$$
$$0 \le x_i \le 1 \quad \forall\, i$$

This is the ideal approach to solve the problem, and is considered to give the optimal solution in every case. Unfortunately, implementation of this exact formulation in CPLEX fails to solve for mining projects of realistic size. Since the optimisation is carried out at the block level, and there is a constraint for every precedence arc for each block, a very large number of constraints are applied. For example, if a mine has 198,917 blocks, and after CPLEX performs preprocessing on the formulation, the resulting reduced LP still has 1,676,003 constraints. CPLEX attempts to solve this formulation using the dual simplex method, generally recognized as the most efficient method for solving linear programs of this size. However, in the case of the example mine, CPLEX was found to crash during the solution process due to the very large number of constraints. Inversion of a constraint matrix of this magnitude (as required for converting solutions obtained from the dual simplex method back into primal space) is considered to place too great a memory requirement on the system.

There still exists a need, however, to improve prior art techniques. Given that mining projects, on the whole, are relatively large scale operations, even small improvements in prior art techniques can represent millions of dollars in savings, and/or greater productivity and/or safety.

It is desirable to provide an improved mine design.

An object of the present invention is to provide an improved method of pit design, which takes into account slope constraints.

Another object of the present invention is to provide an improved method of determining a cluster.

A further object of the present invention is to determine which blocks of a mine pit provide a relative maximum net value of material, also having regard to practical limitations, such as slope constraints.

Yet another object of the present invention is to alleviate at least one disadvantage of the prior art.

Any discussion of documents, devices, acts or knowledge in this specification is included to explain the context of the invention. It should not be taken as an admission that any of the material forms a part of the prior art base or the common general knowledge in the relevant art in Australia or elsewhere on or before the priority date of the disclosure and claims herein.

SUMMARY OF INVENTION

The present invention provides, in a first inventive aspect, a method of and apparatus for determining slope constraints related to a design configuration for extracting material from a particular location, the method including the steps of determining a selected volume of material to be extracted, dividing at least a portion of the selected volume into blocks, forming a plurality of cones, at least one cone from each block, and determining from the cones, a clump having a corresponding slope constraint.

Preferably, the cone is propagated upwards using precedence arcs.

The present aspect also provides a method of determining slope constraints related to a design configuration for extracting material from a particular location, in which precedent arcs emanating from a selected block(s) are used to establish, at least in part, slope constraints.

The present aspect also provides a mine designed in accordance with the method as disclosed herein.

The present aspect further provides a computer program product including a computer usable medium having computer readable program code and computer readable system code embodied on said medium for determining slope constraints related to a design configuration for extracting material from a particular location within a data processing system, the computer program product including computer readable code within said computer usable medium for performing the method as disclosed herein.

In essence, the present invention, referred to as Propagation of clusters and formation of clumps, forms relatively minimal inverted cones with clusters at their apex and intersects these cones to form clumps, or aggregations of blocks that respect slope constraints. Advantageously, it has been found that aggregating the small blocks in an intelligent way serves to reduce the number of "atoms" variables to be fed into the mixed integer programming engine. The clumps allow relatively maximum flexibility in potential mining schedules, while keeping variable numbers to a minimum. The collection of clumps has three important properties. Firstly, the clumps allow access to all the targets as quickly as possible (minimality), and secondly the clumps allow many possible orders of access to the identified ore targets (flexibility). Thirdly, because cones are used, and due to the nature of the cone(s), an extraction ordering of the clumps that is feasible according to the precedence arcs will automatically respect and accommodate minimum slope constraints. Thus, the slope constraints are automatically built into this aspect of invention.

In other words, the present invention provides that clumps are determined from the overlap of cones. The cones are preferably 'minimal'.

The present invention provides, in a second inventive aspect, a method of and apparatus for determining a cluster of material, the method including allocating at least a portion of the material between a plurality of blocks, determining a first attribute related to co-ordinates corresponding to each block, assigning the first attribute to each corresponding block, determining a second attribute related to the plurality of blocks, and aggregating at least two of the plurality of blocks in accordance with the first attribute and the second attribute.

In essence, the second related aspect of invention, referred to as Initial Identification of Clusters, aggregates a number of blocks into collections or clusters. The clusters preferably more sharply identify regions of high-grade and low-grade materials, while maintaining a spatial compactness of a cluster. The clusters are formed by blocks having certain x, y, z spatial coordinates, combined with another coordinate, representing a number of selected values, such as grade or value. The advantage of this is to produce inverted cones that are relatively tightly focused around regions of high grade so as not to necessitate extra stripping.

In other words, where there is an ore body having a number of blocks, the present invention deals with building cones and clumps etc from the information known about the ore body and it's blocks.

The present invention provides, in a third inventive aspect, a method and apparatus of determining characteristics of a selected portion of material, the method including determining the contents of the selected portion of material, and identifying region(s) of material within the selected portion according to at least one of a plurality of characteristic(s).

In essence, a third related aspect of invention, referred to as splitting of waste and ore in clumps, is based on the realisation that clumps contain both ore blocks and waste blocks. Many integer programs assume that the value is distributed uniformly within a clump. This is, however, not true. Typically, clumps will have higher value near their base. This is because most of the value is lower underground while closer to the surface one tends to have more waste blocks. By splitting the clump into relatively pure waste and desirable material, the assumption of uniformity of value for each portion of the clump is more accurate.

In other words, the present invention reflects the consideration to determine, where necessary, block 'grade'. If the ore is above a certain value, then the cone may be divided into smaller cones, and re-iterated for more precise determination and extraction.

The present invention provides, in a fourth inventive aspect, a method of and apparatus for analysing a selected volume of material, the material being at least partially comprised of a plurality of blocks, the method including the steps of clumping a number of blocks together, and analysing the selected volume of material based on the clumped blocks.

In essence, a fourth related aspect of invention, referred to as Aggregation of blocks into clumps; high-level ideas, reduces the number of variables to a relatively manageable amount for use in current technology of integer programming engines. Advantageously, this aspect enables the use of an integer programming engine and the ability to incorporate further constraints such as mining, processing, and marketing capacities, and grade constraints.

The present invention provides, in a fifth inventive aspect, a method of determining a selected group of blocks of a mine pit which are capable of being mined, the method including the steps of selecting a plurality of blocks, and determining a relative value and constraints applicable to the selected blocks in accordance with any one of the equations 3, 4 or 9 as disclosed herein.

The present invention also provides the method as described above and including the further step of testing for violations.

The present invention also seeks to reiterate the selection and determination of value and constraints of blocks in order to obtain a group of blocks which have a relative optimal mining value.

In essence, the present aspect, in one form, utilises aggregating algorithm(s) to determine a selected group of blocks which are to be mined, where the selection of blocks to be included into the group of blocks is made relative to value and constraints applicable to the blocks. The present invention, in another aspect further tests for violations, and iteratively recalculates until substantially all violations are removed. Given a block model of an ore body containing value-in-ground and designated slope constraints, the ultimate pit problem concerns the determination of the shape of the final pit of the mine. It is assumed that all the material can be removed at once. That is, the effect of time on the value of the ore body is not considered. In terms of mine scheduling, the ultimate pit can be used as the initial collection of blocks on which a scheduling algorithm is run. In this respect, the ultimate pit is the largest possible final pit that can be realised following scheduling of removal of the ore body. The case considered throughout this disclosure is that of base metals but also has application to blended products or stochastic elements of open-pit mining.

In other words, the present invention is used to determine how to split a relatively large ore body into clump(s). The present invention can be used to ensure that the clump or ore body is not too large, computationally, for example for practical consideration with the use of existing algorithms.

Other related aspects of invention, include:

In essence, one related aspect of invention, referred to as Generic Klumpking, is a method of mine design that firstly, is considered a clever choice of aggregation to reduce the number of variables via a spatial/value clustering and propagation to form clumps. Secondly, the inclusion of mining and processing constraints in an integer program based around the clump variables to ultimately produce an optimal block sequence. Thirdly, the rapid loop of clustering blocks in this optimal sequence according to space/time of extraction and propagating these clusters to form pushbacks, interrogating them for value and mineability, and adjusting clustering parameters as needed.

In essence, another related aspect of invention, referred to as Determination of a block ordering from a clump ordering, turns a clump ordering into an ordering of blocks. This is, in effect, a de aggregation. Using techniques disclosed herein, the integer program engine was used on the relatively small number of clumps, and thus the result can now be translated back into the large number of small blocks.

In essence, still another related aspect of invention, referred to as 'fuzzy clustering; second identification of clusters for pushback design, clusters blocks according to their spatial position and their time of extraction. This is considered necessary because if pushbacks were formed from the block sequence in its raw form, the pushbacks would be generally highly fragmented and considered non-mineable. The clustering gives control over the connectivity and mineability of the resulting pushbacks.

In essence, still another related aspect of invention, referred to as fuzzy clustering; alternative 1, clusters blocks according to their spatial position and their time of extraction. The clusters may be controlled to be a certain size, or have a certain rock tonnage or ore tonnage. The shapes of the clusters may be controlled through parameters that balance the space and the time coordinate. The advantage of shape control is to produce pushbacks that are mineable and not fragmented. The advantage of size control is the ability to control stripping ratios in years where the mill may be operating under capacity.

In essence, a further related aspect of invention, referred to as fuzzy clustering; alternative 2, propagates inverted cones from the clusters identified in the secondary clustering. The clusters in the secondary clustering are time ordered, and the propagation occurs in this time order, with no intersections of inverted cones allowed. Advantageously, this provides the ability to extract pushbacks from the block ordering that are well connected and mineable, while retaining the bulk of the NPV optimality of the block sequence.

In essence, still a further related aspect of invention, referred to as fuzzy clustering; alternative 3, provides the creation of a feedback loop of clustering, propagating to find pushbacks, valuing relatively quickly, and then feeding this information back into the choice of clustering parameters. The advantage of this is that the effect of different clustering parameters may be very quickly checked for NPV and mineability. It is heretofore been virtually impossible to evaluate a pushback design for NPV and mineability before it has been constructed, and the fast process loop of this aspect allows many high-quality pushbacks designs to be constructed and evaluated (by the human eye in the case of mineability).

Other aspects and preferred aspects are disclosed in the specification and/or defined in the appended claims.

The method(s), systems and techniques disclosed in this application may be used in conjunction with prior art integer programming engines. Many aspects of the present disclosure serve to improve the performance of the use of such engines and the use of other known mine design techniques.

The present invention may be used, for example, by mine planners to design relatively optimal pushbacks for open cut mines. Advantageously, the present invention is considered is different to prior art pushback design software in that:

The present invention does not use either of the most common pit design algorithms (Lerchs-Grossmann or Floating Cone) but instead uses a unique concept of optimal "clump" sequencing to develop an optimal block sequence that is then used as a basis for pushback design.

The design is relatively optimal with respect to properly discounted block values. No other pushback design software is considered to correctly allow for the effect of time (viz: block value discounting) in the pushback design step. Traditional phase designs ignore medium grade ore pods close to the surface with good NPV whilst focussing on higher value pods that may be deeply buried.

The present invention can properly address the so-called "Whittle-gap" problem where consecutive Lerchs-Grossmann shells can be very far apart, offering little temporal information. The present invention obtains relatively complete and accurate temporal information on the block ordering.

Process and mining constraints can be explicitly incorporated into the pushback design step.

The planner can rapidly design and value pushbacks that have different topologies, the trade-off being between pits with high NPV, but with difficult-to-mine (eg: ring) pushback shapes, and those with more mineable pushback shapes but lower NPV. The advantage of the more mineable pushback shapes is that much less NPV will be wasted in enforcing minimum mining width and in accommodating pit access (roads and berms).

The ability to quickly generate and evaluate a number of different sets of candidate pushback designs is a feature not allowed in traditional pushback design software where design options are usually fairly limited (eg: the amalgamation of adjacent Whittle shells into a single pushback)

Various aspects of the present invention also serve to improve the use of existing integer programming engines, such as "cplex" by ILOG.

Throughout the specification:

1. a 'collection' is a term for a group of objects, 2. a 'cluster' is a collection of ore blocks or blocks of otherwise desirable material that are relatively close to one another in terms of space and/or other attributes, 3. a 'clump' is formed from a cluster by first producing a substantially minimal inverted cone extending from the cluster to the surface of the pit by propagating all blocks in the cluster upwards using the arcs that describe the minimal slope constraints. Each cluster will have its own minimal inverted cone. These minimal inverted cones are then intersect with one another and the intersections form clumps, and 4. an 'aggregation' is a term, although mostly applied to collections of blocks that are spatially connected (no "holes" in them). For example, a clump may be an aggregation, or may be "Super blocks" that are larger cubes made by joining together smaller cubes or blocks.

5. reference to block constraints equally implies reference to arc constraints.

6. a block may also refer to a number of blocks.

DESCRIPTION OF DRAWINGS

Further disclosure, objects, advantages and aspects of the present application may be better understood by those skilled in the relevant art with reference to the following description of preferred embodiments taken in conjunction with the accompanying drawings, in which:

FIGS. 1 to 5 illustrate prior art mining techniques,

FIGS. 11*a*, 11*b* and 11*c* illustrate a secondary clustering, propagation, and NPV valuation process.

DETAILED DESCRIPTION

In order to more fully describe the present invention, a number of related aspects will also be described. In this way, the reader can gain a better understanding of the context and scope of the present invention.

1. Generic KlumpKing

Figure 1:
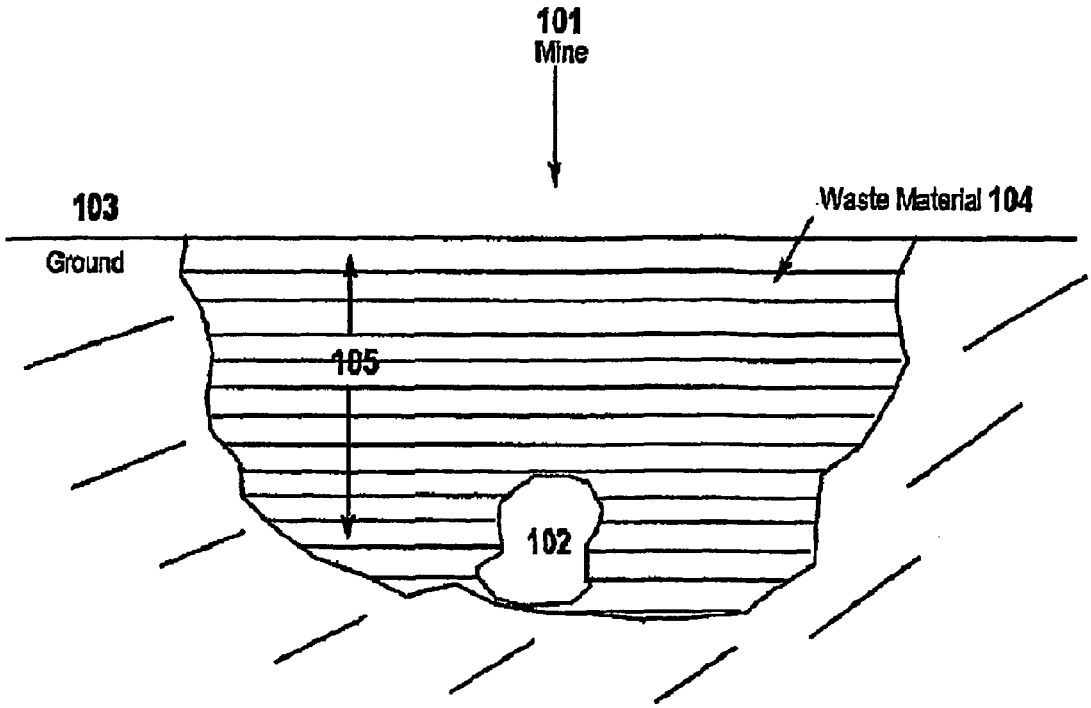
Figure 1 (prior art)
Figure 2:
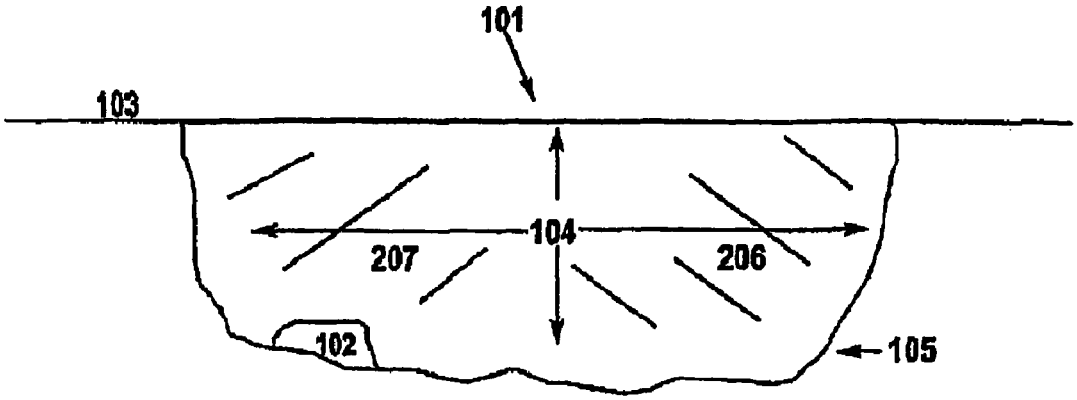
Figure 2 prior art
Figure 5:
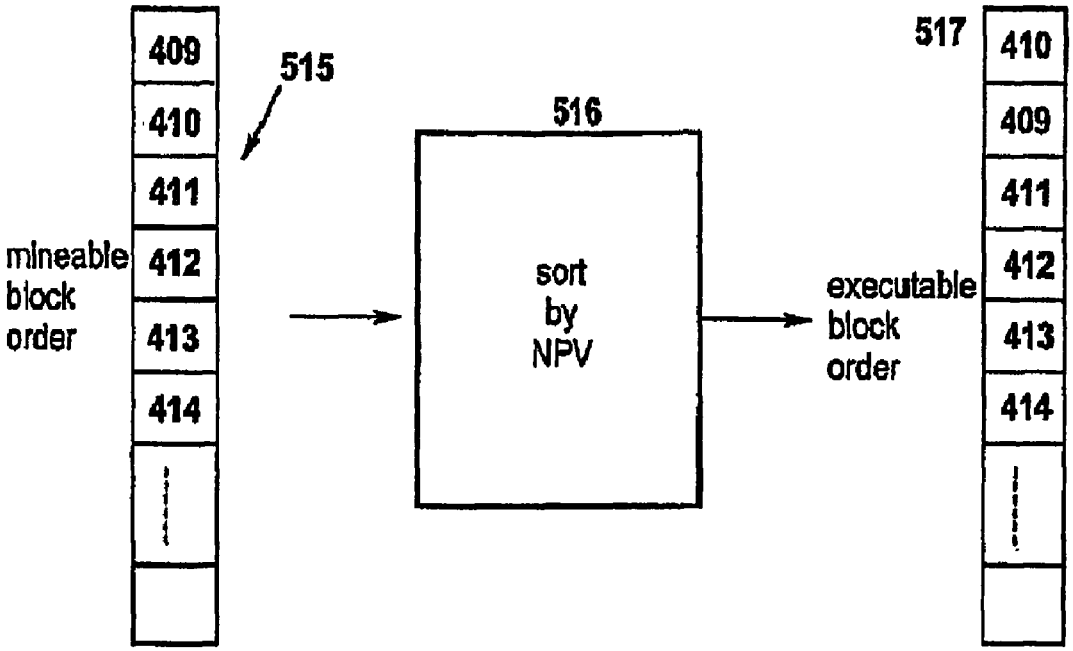
Figure 5 prior art
Figure 6:
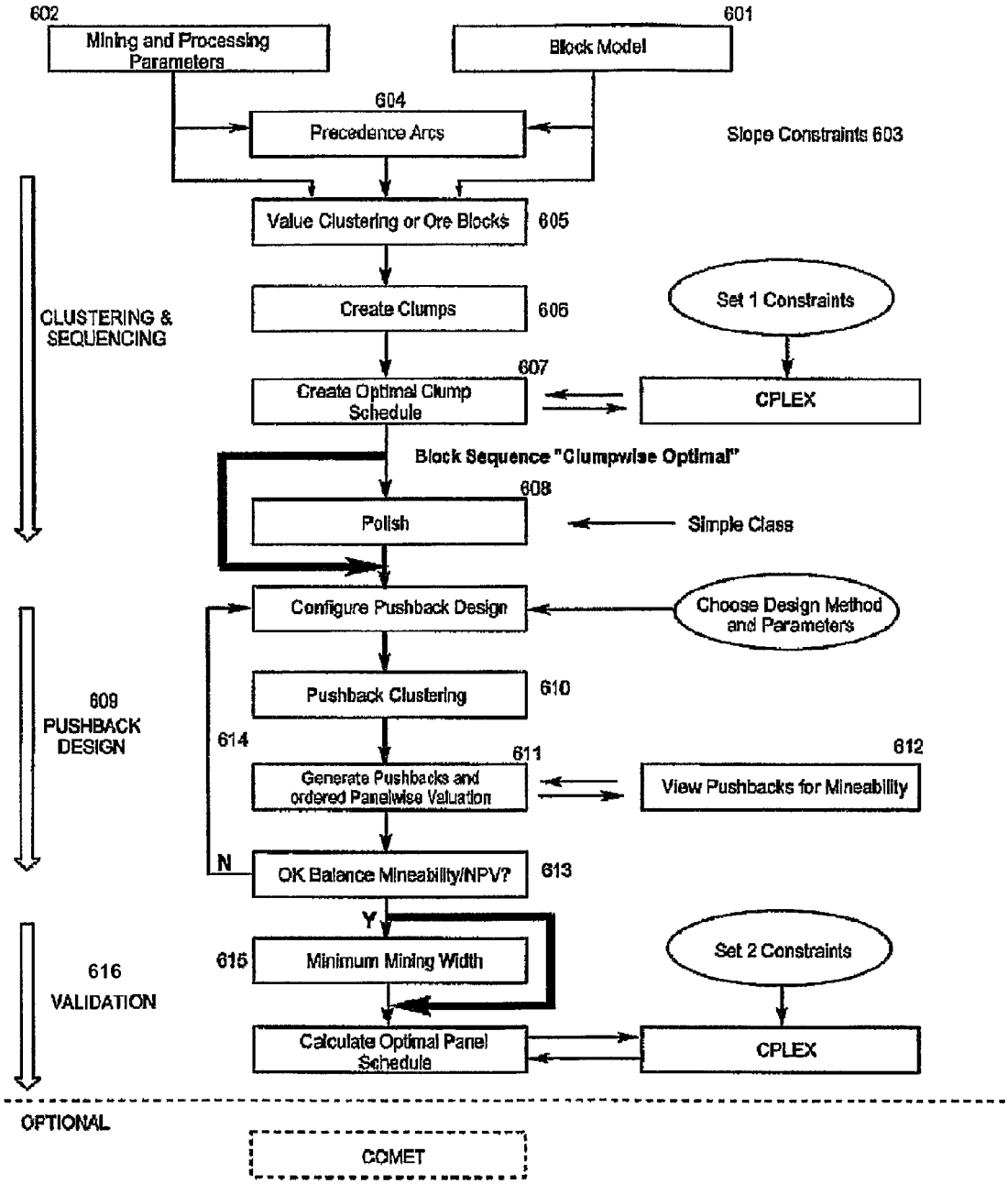
FIG. 6 illustrates, schematically, a flow chart outlining the overall process according to one aspect of invention.

FIG. 6 illustrates, schematically an overall representation of one aspect of invention.

Although specific aspects of various elements of the overall flow chart are discussed below in more detail, it may be helpful to provide an outline of the flow chart illustrated in FIG. 6.

Block model 601, mining and processing parameters 602 and slope constraints 603 are provided as input parameters. When combined, precedence arcs 604 are provided. For a given block, arcs will point to other blocks that must be removed before the given block can be removed.

As typically, the number of blocks can be very large, at 605, blocks are aggregated into larger collections, and clustered. Cones are propagated from respective clusters and clumps are then created 606 at intersections of cones. The number of clumps is now much smaller than the number of blocks, and clumps include slope constraints. At 607, the clumps may then be scheduled in a manner according to specified criteria, for example, mining and processing constraints and NPV. It is of great advantage that the scheduling occurs with clumps (which number much less than blocks). It is, in part, the reduced number of clumps that provides a relative degree of arithmetic simplicity and/or reduced requirements of the programming engine or algorithms used to determine the schedule. Following this, a schedule of individual block order can be determined from the clump schedule, by de-aggregating. The step of polish at 608 is optional, but does improve the value of the block sequence.

From the block ordering, pushbacks can be designed 609. Secondary clustering can be undertaken 610, with an additional fourth co-ordinate. The fourth co-ordinate may be time, for example, but may also be any other desirable value or parameter. From here, cones are again propagated from the clusters, but in a sequence commensurate with the fourth co-ordinate. Any blocks already assigned to previously propagated cones are not included in the next cone propagation. Pushbacks are formed 611 from these propagated cones. Pushbacks may be viewed for mineability 612. An assessment as to a balance between mineability and NPV can be made at 613, whether in accordance with a predetermined parameter or not. The pushback design can be repeated if necessary via path 614.

Other consideration can also be taken into account, such as minimum mining width 615, and validation 616. Balances can be taken into account for mining constraints, downstream processing constraints and/or stockpiling options, such as blending and supply chain determination and/or evaluation.

The following description focuses on a number of aspects of invention which reside within the overall flow chart disclosed above. For the purposes of FIG. 6, sections 2 and 5 are associated with 605, sections 3, 4 and 5 are associated with 606, sections 4, 6 are associated with 607, sections 7 and 7.3 are associated with 610, sections 7.2 and 7.3 are associated with 611, section 7.3 is associated with 612, 613 and 614, and sections 7, 7.1, 7.2 and 7.3 are associated with 609.

1.1 Inputs and Preliminaries

Input parameters include the block model 601, mining and processing parameters 602, and slope constraints 603. Slope regions (eg. physical areas or zones) are contained in 601; slope parameters (eg. slopes and bearings for each zone) are contained in 602.

The block model 601 contains information, for example, such as the value of a block in dollars, the grade of the block in grams per tonne, the tonnage of rock in the block, and the tonnage of ore in the block.

The mining and processing parameters 602 are expressed in terms of tonnes per year that may be mined or processed subject to capacity constraints.

The slope constraints 603 contain information about the maximal slope around in given directions about a particular block.

The slope constraints 603 and the block model 601 when combined give rise to precedence arcs 604. For a given block, arcs will point from the given block to all other blocks that must be removed before the given block. The number of arcs is reduced by storing them in an inductive, where, for example, in two dimensions, an inverted cone of blocks may be described by every block pointing to the three blocks centred immediately above it. This principle can also be applied to three dimensions. If the inverted cone is large, for example having a depth of 10, the number of arcs required would be 100; one for each block. However, using the inductive rule of "point to the three blocks centred directly above you", the entire inverted cone may be described by only three arcs instead of the 100. In this way the number of arcs required to be stored is greatly reduced. As block models typically contain hundreds of thousands of blocks, with each block containing hundreds of arcs, this data compression is considered a significant advantage.

1.2 Producing an Optimal Block Ordering

The number of blocks in the block model 601 is typically far too large to schedule individually, therefore it is desirable to aggregate the blocks into larger collections, and then to schedule these larger collections. To proceed with this aggregation, the ore blocks are clustered 605 (these are typically located towards the bottom of the pit. In one preferred form, those blocks with negative value, which are taken to be waste, are not clustered). The ore blocks are clustered spatially (using their x, y, z coordinates) and in terms of their grade or value. A balance is struck between having spatially compact clusters, and clusters with similar grade or value within them. These clusters will form the kernels of the atoms of aggregation.

From each cluster, an (imaginary) inverted cone is formed, by propagating upwards using the precedence arcs. This inverted cone represents the minimal amount of material that must be excavated before the entire cluster can be extracted. Ideally, for every cluster, there is an inverted cone. Typically, these cones will intersect. Each of these intersections (including the trivial intersections of a cone intersecting only itself) will form an atom of aggregation, which is call a clump. Clumps are created, represented by 606.

The number of clumps produced is now far smaller than the original number of blocks. Precedence arcs between clumps are induced by the precedence arcs between the individual blocks. An extraction ordering of the clumps that is feasible according to these precedence arcs will automatically respect minimum slope constraints. It is feasible to schedule these clumps to find a substantially NPV maximal, clump schedule 607 that satisfies all of the mining and processing constraints.

Now that there is a schedule of clumps 607, this can be turned into a schedule of individual blocks. One method is to consider all of those clumps that are begun in a calendar year one, and to excavate these block by block starting from the uppermost level, proceeding level by level to the lowermost level. Other methods are disclosed in Section 6 of this specification. Having produced this block ordering, the next step may be to optionally Polish 608 the block ordering to further improve the NPV.

In a more complex case, the step of polish 608, can be bypassed. If it is desirable, however, polishing can be performed to improve the value of the block sequence.

1.3 Balanced NPV Optimal/mineable Pushback Design from Block Ordering

From this block ordering, we can produce pushbacks, via pushback design 609. Advantageously, the present invention enables the creation of pushbacks that allow for NPV optimal mining schedules. A pushback is a large section of a pit in which trucks and shovels will be concentrated to dig, sometimes for a period of time, such as for one or more years. The block ordering gives us a guide as to where one should begin and end mining. In essence, the block ordering is an optimal way to dig up the pit. However, often this block ordering is not feasible because the ordering suggested is too spatially fragmented. In an aspect of invention, the block ordering is aggregated so that large, connected portions of the pits are obtained (pushbacks). Then a secondary clustering of the ore blocks can be undertaken 610. This time, the clustering is spatial (x, y, z) and has an additional 4th coordinate, which represents the block extraction time ordering. The emphasis of the 4th coordinate of time may be increased and decreased. Decreasing the emphasis produces clusters that are spatially compact, but ignore the optimal extraction sequence. Increasing the emphasis of the 4th coordinate produces clusters that are more spatially fragmented but follow the optimal extraction sequence more closely.

Once the clusters have been selected (and ordered in time), inverted cones are propagated upwards in time order. That is, the earliest cluster (in time) is propagated upwards to form an inverted cone. Next, the second earliest cluster is propagated upwards. Any blocks that are already assigned to the first cone are not included in the second cone and any subsequent cones. Likewise, any blocks assigned to the second cone are not included in any subsequent cones. These propagated cones or parts of cones form the pushbacks 611. This secondary clustering, propagation, and NPV valuation is relatively rapid, and the intention is that the user would select an emphasis for the 4th coordinate of time, perform the propagation and valuation, and view the pushbacks for mineability 612. A balance between mineability and NPV can be accessed 613, and if necessary the pushback design steps can be repeated, path 614. For example, if mineability is too fragmented, the emphasis of the 4th coordinate would be reduced. If the NPV from the valuation is too low, the emphasis of the 4th coordinate would be increased.

Once a pushback design has been selected, a minimum mining width routine 615 is run on the pushback design to ensure that a minimum mining width is maintained between the pushbacks and themselves, and the pushbacks and the boundary of the pit. An example in the open literature is "The effect of minimum mining width on NPV" by Christopher Wharton & Jeff Whittle, "Optimizing with Whittle" Conference, Perth, 1997.

1.4 Further Valuation

A more sophisticated valuation method 616 is possible at this final stage that balances mining and processing constraints, and additionally could take into account stockpiling options, such as blending and supply chain determination and/or evaluation.

2 Initial Identification of Clusters

It has been found that the number of blocks in a block model is typically far too large to schedule individually, therefore in accordance with one related aspect of invention, the blocks are aggregated into larger collections. These larger collections are then preferably scheduled. Scheduling means assigning a clump to be excavated in a particular period or periods.

Figure 7:
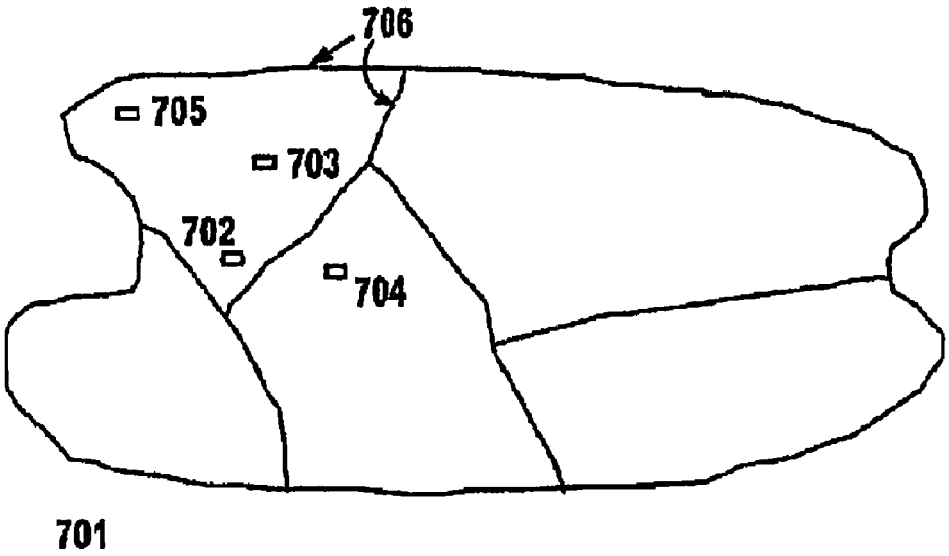
FIG. 7 illustrates schematically the identification of clusters.

To proceed with the aggregation, a number of ore blocks are clustered. Ore blocks are identified as different from waste material. The waste material is to be removed to reach the ore blocks. The ore blocks may contain substantially only ore of a desirably quality or quantity and/or be combined with other material or even waste material. The ore blocks are typically located towards the bottom of the pit, but may be located any where in the pit. In accordance with a preferred aspect of the present invention, the ore blocks which are considered to be waste are given a negative value, and the ore blocks are not clustered with a negative value. It is considered that those blocks with a positive value, present themselves as possible targets for the staging of the open pit mine. This approach is built around targeting those blocks of value, namely those blocks with positive value. Waste blocks with a negative value are not considered targets and are therefore this aspect of invention does not cluster those targets. The ore blocks are clustered spatially (using their x, y, z coordinates) and in terms of their grade or value. Preferably, limits or predetermined criteria are used in deciding the clusters. For example, what is the spatial limit to be applied to a given cluster of blocks? Are blocks spaced 10 meters or 100 meters apart considered one cluster? These criteria may be varied depending on the particular mine, design and environment. For example, FIG. 7 illustrates schematically an ore body 701. Within the ore body are a number of blocks 702, 703, 704 and 705. (The ore body has many blocks, but the description will only refer to a limited number for simplicity) Each block 702, 703, 704 and 705 has its own individual x, y, z coordinates. If an aggregation is to be formed, the coordinates of blocks 702, 703, 704 and 705 can be analysed according to a predetermined criteria. If the criteria is only distance, for example, then blocks 702, 703 and 704 are situated closer than block 705. The aggregation may be thus formed by blocks 702, 703 and 704. However, if, in accordance with this aspect of invention, another criteria is also used, such as grade or value, blocks 702, 703 and 705 may be considered an aggregation as defined by line 706, even though block 704 is situated closer to blocks 702 and 703. A balance is struck between having spatially compact clusters, and clusters with similar grade or value within them. These clusters will form the kernels of the atoms of aggregation. It is important that there is control over spatial compactness versus the grade/value similarity. If the clusters are too spatially separated, the inverted cone that we will ultimately propagate up from the cluster (as will be described below) will be too wide and contain superfluous stripping. If the clusters internally contain too much grade or value variation, there will be dilution of value. It is preferable for the clusters to substantially sharply identify regions of high grade and low-grade separately, while maintaining a spatial compactness of the clusters. Such clusters have been found to produce high-quality aggregations.

Furthermore, where a relatively large body of ore is encountered, the ore body may be divided into a relatively large number of blocks. Each block may have substantially the same or a different ore grade or value. A relatively large number of blocks will have spatial difference, which may be used to define aggregates and clumps in accordance with the disclosure above. The ore body, in this manner may be broken up into separate regions, from which individual cones can be defined and propagated.

3 Propagation of Clusters and Formation of Clumps

From each cluster, an inverted cone (imaginary) is formed. A cone is referred to as a manner of explaining visually to the reader what occurs. Although the collection of blocks forming the cone does look like a discretised cone to the human eye. In a practical embodiment, this step would be simulated mathematically by computer. Each cone is preferably a minimal cone, that is, not over sized. This cone is represented schematically or mathematically, but for the purposes of explanation it is helpful to think of an inverted cone propagating upward of the aggregation. The inverted cone can be propagated upwards of the atom of aggregation using the precedence arcs. Most mine optimisation software packages use the idea of precedence arcs. The cone is preferably three dimensional. The inverted cone represents the minimal amount of material that must be excavated before the entire cluster can be extracted. In accordance with a preferred form of this aspect of invention, every cluster has a corresponding inverted cone.

Typically, these cones will intersect another cone propagating upwardly from an adjacent aggregation. Each intersection (including the trivial intersections of a cone intersecting only itself) will form an atom of aggregation, which is call a 'clump', in accordance with this aspect. Precedence arcs between clumps are induced by the precedence arcs between the individual blocks. These precedence arcs are important for identifying which extraction ordering of clumps are physically feasible and which are not. Extraction orderings must be consistent with the precedence arcs. This means that if block/clump A points to block/clump B, then block/clump B must be excavated earlier than block/clump A.

Figure 8:
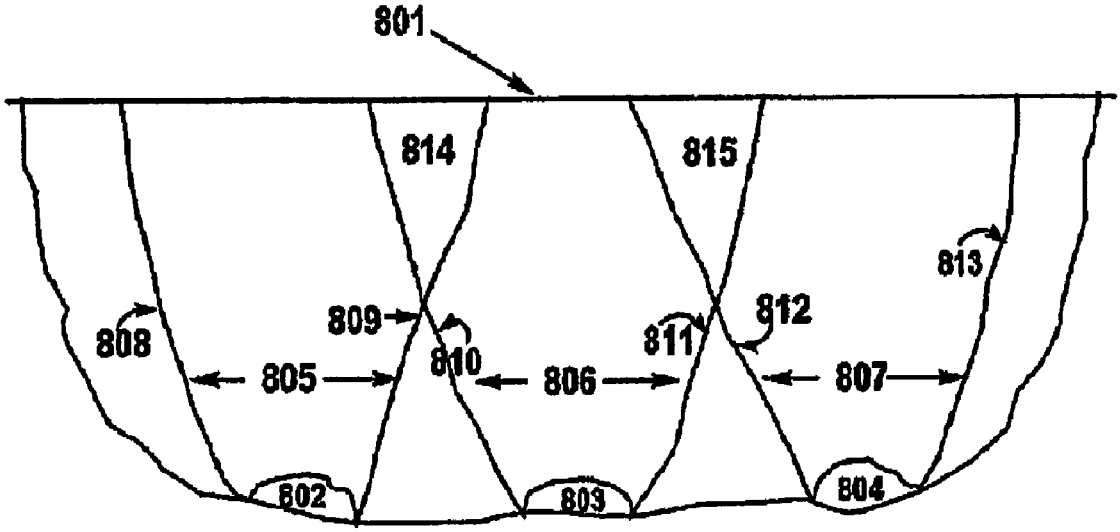
FIG. 8 illustrates schematically cone propagation in pit design.

With reference to FIG. 8, illustrating a pit 801, in which there are ore bodies 802, 803, and 804. Having identified the important "ore targets" in the stage of initial identification of clusters, as described above, the procedure of propagation and formation of clumps goes on to produce mini pits (clumps) that are the most efficient ways access these "ore targets". The clumps are the regions formed by an intersection of the cones, as well as the remainder of cones once the intersected areas are removed. In accordance with the embodiment aspect, intersected areas must be removed before any others, eg. 814 must be dug up before either 805 or 806, in FIG. 8. In accordance with the description above, cones 805, 806 and 807 are propagated (for the purposes of illustration) from ore bodies to be extracted. The cones are formed by precedence arcs 808, 809, 810, 811, 812 and 813. In FIG. 8, for example, clumps are designated regions 814 and 815. Other clumps are also designated by what is left of the inverted cones 805, 806 and 807 when 814 and 815 have been removed. The clump area is the area within the cone. The overlaps, which are the intersections of the cones, are used to allow the excavation of the inverted cones in any particular order. The collection of clumps has three important properties. Firstly, the clumps allow access to the all targets as quickly as possible (minimality), and secondly the clumps allow many possible orders of access to the identified ore targets (flexibility). Thirdly, because cones are used, an extraction ordering of the clumps that is feasible according to the precedence arcs will automatically respect and accommodate minimum slope constraints. Thus, the slope constraints are automatically built into this aspect of invention.

4 Splitting of Waste and Ore in Clumps

Figure 9:
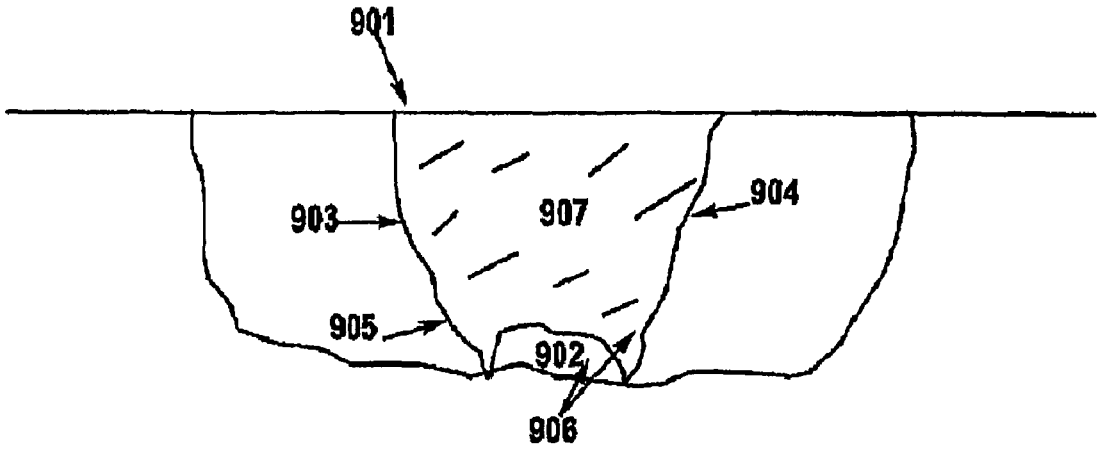
FIG. 9 illustrates schematically the splitting or ore from waste material.

Once the initial clumps have been formed, a search is performed from the lowest level of the clump upwards. The highest level at which ore is contained in the clump is identified; everything above this level is considered to be waste. The option is given to split the clump into two pieces; the upper piece contains waste, and the lower piece contains a mixture of waste and ore. FIG. 9 illustrates a pit 901, in which there is an ore body 902. From the ore body, precedence arcs 903 and 904 define a cone propagating upward. In accordance with this aspect of invention, line 905 is identified as the highest level of the clump 902. Then 906 can designate ore, and 907 can designate waste. This splitting of waste from ore designations is considered to allow for a more accurate valuation of the clump. Many techniques assume that the value within a clump is uniformly distributed, however, in practice this is often not the case. By splitting the clump into two pieces, one with pure waste and the other with mostly ore, the assumption of homogeneity is more likely to be accurate. More sophisticated splitting based on finer divisions of value or grade are also possible in accordance with predetermined criteria, which can be set from time to time or in accordance with a particular pit design or location.

5 Aggregation of Blocks into Clumps: High-level Ideas

The feature of 'clumping blocks together' may be viewed for the purpose of arithmetic simplicity where the number of blocks are too large. The number of clumps produced is far smaller than the original number of blocks. This allows a mixed integer optimisation engine to be used, otherwise the use of mixed integer engines would be considered not feasible. For example, Cplex by ILOG may be used. This aspect has beneficial application to the invention disclosed in pending provisional patent application no. 2002951892, titled "Mining Process and Design" filed 10 Oct. 2002 by the present applicant, and which is herein incorporated by reference. This aspect can be used to reduce problem and calculation size for other methods (such as disclosed in the co-pending application above).

The number of clumps produced is far smaller than the original number of blocks. This allows a mixed integer optimisation engine to be used. The advantage of such an engine is that a truly optimal (in terms of maximising NPV) schedule of clumps may be found in a (considered) feasible time. Moreover this optimal schedule satisfies mining and processing constraints. Allowing for mining and processing constraints, the ability to find truly optimal solutions represents a significant advance over currently available commercial software. The quality of the solution will depend on the quality of the clumps that are input to the optimisation engine. The selection procedures to identify high quality clumps have been outlined in the sections above.

Some commercial software, as noted in the background section of this specification, do use mixed integer programming engines, however, the method of aggregating blocks is different either in method, or in application, and we believe of lower-quality. For example, it is considered that 'ECSI Maximiser' uses a form of integer optimisation in their pushback design, and restricts the time window for each block, but the optimisation is local in time, and it's problem formulation is considered too large to optimise globally over the life of a mine. In contrast, in accordance with the present invention, a global optimisation over the entire life of mine is performed by allowing clumps to be taken at any time from start of mine life to end of mine life. 'MineMax' may be used to find rudimentary optimal block sequencing with a mixed integer programming engine, however it is considered that it's method of aggregation does not respect slopes as is required in many situations. 'MineMax' also optimises locally in time, and not globally. In use, there is a large huge number of variables, and the user must therefore resort to subdividing the pit to perform separate optimisations, and thus the optimisation is not global over the entire pit. The present invention is global in both space and time.

6 Determination of a Block Ordering from a Clump Ordering

Now that there is a schedule of clumps, it is desirable to turn this into a schedule of individual blocks. One method is to consider all of those clumps that are begun in year one, and to excavate these block by block starting from the uppermost level, proceeding level by level to the lowermost level. One then moves on to year two, and considers all of those clumps that are begun in year two, excavating all of the blocks contained in those clumps level by level from the top level through to the bottom level. And so on, until the end of the mine life.

Typically, some clumps may be extracted over a period of several years. This method just described is not as accurate as may be required for some situations, because the block ordering assumes that the entire clump is removed without stopping, once it is begun. Another method is to consider the fraction of the clump that is taken in each year. This method begins with year one, and extracts the blocks in such a way that the correct fractions of each clump for year one are taken in approximately year one. The integer programming engine assigns a fraction of each clump to be excavated in each period/year. This fraction may also be zero. This assignment of clumps to years or periods must be turned into a sequence of blocks. This may be done as follows. If half of the clump A is taken in year one, and one third of clump B is taken in year one, and all other fractions of clumps in year one are zero, the blocks representing the upper half of clump A and the blocks representing the upper one-third of clump B are joined together. This union of blocks is then ordered from the uppermost bench to the lowermost bench and forms the beginning of the blocks sequence (because we are dealing with year one). One then moves on to year two and repeats the procedure, concatenating the blocks with those already in the sequence.

Having produced this block ordering, block ordering may be in a position to be optionally Polished to further improve the NPV. The step of Polishing is similar to the method disclosed in co-pending application 2002951892 (described above, and incorporated herein by reference) but the starting condition is different. Rather than best value to lowest value, as is disclosed in the co-pending application, in the present aspect, the start is with the block sequence obtained from the clump schedule.

7 Second Identification of Clusters for Pushback Design 7.1 Fuzzy Clustering; Alternative 1 (Space/time Clustering of Block Sequence)

From this block ordering, we must produce pushbacks. This is the ultimate goal of KlumpKing—to produce pushbacks that allow for NPV optimal mining schedules. A pushback is a large section of a pit in which trucks and shovels will be concentrated for one or more years to dig. The block ordering gives us a guide as to where one should begin and end mining. In principle, the block ordering is the optimal way to dig up the pit. However, it is not feasible, because the ordering is too spatially fragmented. It is desirable to aggregate the block ordering so that large, connected portions of the pits are obtained (pushbacks). A secondary clustering of the ore blocks is undertaken. This time, clustering is spatially (x, y, z) and as a 4th coordinate, which is used for the block extraction time or ordering. The emphasis of the 4th coordinate of time may be increased or decreased. Decreasing the emphasis produces clusters that are spatially compact, but tend to ignore the optimal extraction sequence. Increasing the emphasis produces clusters that are more spatially fragmented but follow the optimal extraction sequence more closely.

Once the clusters have been selected, they may be ordered in time. The clusters are selected based on a known algorithm of fuzzy clustering, such as J C Bezdek, R H Hathaway, M J Sabin, W T Tucker. "Convergence Theory for Fuzzy c-means: Counterexamples and Repairs". IEEE Trans. Systems, Man, and Cybernetics 17 (1987) pp 873-877. Fuzzy clustering is a clustering routine that tries to minimise distances of data points from a cluster centre. In this inventive aspect, the cluster uses a four-dimensional space; (x, y, z, v), where x, y and z give spatial coordinates or references, and 'v' is a variable for any one or a combination of time, value, grade, ore type, time or a period of time, or any other desirable factor or attribute. Other factors to control are cluster size (in terms of ore mass, rock mass, rock volume, $value, average grade, homogeneity of grade/value), and cluster shape (in terms of irregularity of boundary, spherical-ness, and connectivity). In one specific embodiment, 'v' represents ore type. In another embodiment, clusters may be ordered in time by accounting for 'v' as representing clusters according to their time centres.

There is also the alternative embodiment of controlling the sizes of the clusters and therefore the sizes of the pushbacks. "Size" may mean rock tonnage, ore tonnage, total value, among other things. In this aspect, there is provided a fuzzy clustering algorithm or method, which in operation serves to, where if a pushback is to begin, its corresponding cluster may be reduced in size by reassigning blocks according to their probability of belonging to other clusters.

There is also another embodiment, where there is an algorithm or method that is a form of 'crisp', as opposed to fuzzy, clustering, specially tailored for the particular type of size control and time ordering that are found in mining applications. This 'crisp' clustering is based on a method of slowly growing clusters while continually shuffling the blocks between clusters to improve cluster quality.

7.2 Fuzzy Clustering; Alternative 2 (Propagation of Clusters)

Having disclosed clustering, above, another related aspect of invention is to then propagate these clusters in a time ordered way without using intersections, to produce the pushbacks.

Figure 10:
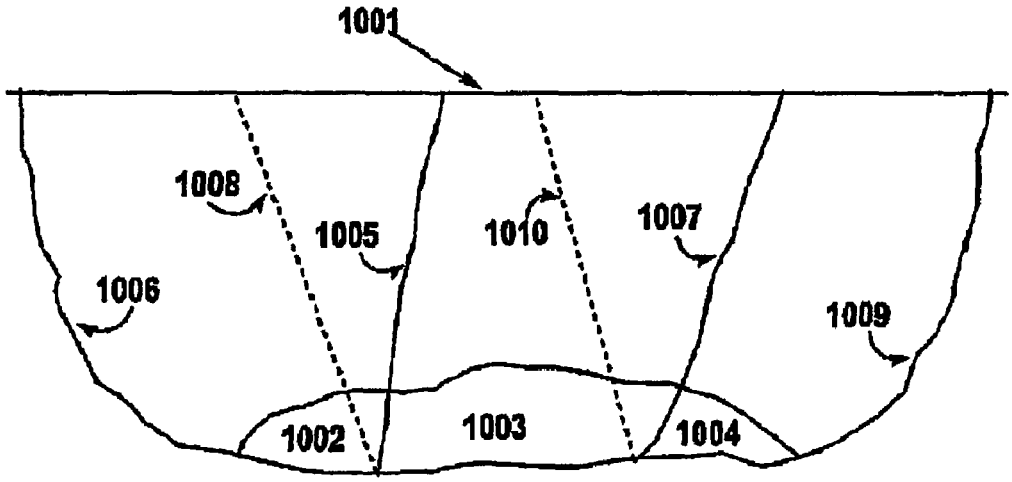
FIG. 10 illustrates an example of 'fuzzy clustering' in a mine site.

Referring to FIG. 10, a mine site 1001 is schematically represented, in which there is an ore body of 3 sections, 1002, 1003, and 1004.

Inverted cones are then propagated upwards in a time order, as represented in FIG. 10, by lines 1005 and 1006 for cone 1. That is, the earliest cluster (in time) is propagated upwards to form an inverted cone. Next, the second earliest cluster is propagated upwards, as represented in FIG. 10 by lines 1007 and 1008 (dotted) for cone 2, and lines 1009 and 1010 (dotted) for cone 3. Any blocks that are already assigned to the first cone are not included in the second cone. This is represented in FIG. 10 by the area between lines 1008 and 1005. This area remains a part of cone 1 according to this inventive aspect. Again, in FIG. 10, the area between lines 1010 and 1007 remains a part of cone 2, and not any subsequent cone. This method is applied to any subsequent cones. Likewise, any blocks assigned to the second cone are not included in any subsequent cones. These propagated cones or parts of cones form the pushbacks.

7.3 Fuzzy Clustering; Alternative 3 (Feedback Loop of Pushback Design)

In this related aspect, there is a process loop of clustering, propagating to find pushbacks, valuing relatively quickly, and then feeding this information back into the choice of clustering parameters.

This secondary clustering, propagation, and NPV valuation is relatively rapid, and the intention is that there would be an iterative evaluation of the result, either by computer or user, and accordingly the emphasis for the 4th coordinate can be selected, the propagation and valuation can be considered and performed, and the pushbacks for mineability can also be considered and reviewed. If the result is considered too fragmented, the emphasis of the 4th coordinate may be reduced. If the NPV from the valuation is too low, the emphasis of the 4th coordinate may be increased.

Referring to FIG. 11*a*, there is illustrated in plan view a two dimensional slice of a mine site. In the example there are 15 blocks, but the number of blocks may be any number. In this example, blocks have been numbered to correspond with extraction time, where 1 is earliest extraction, and 15 is latest extraction time. In the example illustrated, the numbers indicate relatively optimal extraction ordering.

In accordance with the aspect disclosed above, FIG. 11*b* illustrates an example of the result of clustering where there is a relatively high fudge factor and relatively high emphasis on time. Cluster number 1 is seen to be fragmented, has a relatively high NPV but is not considered mineable.

In accordance with the aspect disclosed above, FIG. 11*c* illustrates an example of the result of clustering where there is a lower emphasis on time, as compared to FIG. 11*b*. The result illustrated is that both clusters number one and two are connected, and 'rounded', and although they have a slightly lower NPV, the clusters are considered mineable.

8. Aggregation of Precedence Constraints

An approach in accordance with a first aspect of invention is to aggregate the precedence constraints as follows:

$$\max \sum_i v_i x_i \qquad \text{equation 3}$$

$$\text{s.t.}$$

$$n_i x_i \le \sum_{j \in P(i)} x_j$$

$$x_i \in \{0, 1\} \quad \forall\, i$$

$$\text{where } n_i = |P(i)|$$

In this first aspect approach, the number of constraints is reduced to one for every block below the surface (there are no precedence constraints for the blocks on the top bench of the pit). In this case each constraint enforces the rule that a block can only be extracted if all of its predecessor blocks are extracted. However, the total unimodularity property of the exact (disaggregated) formulation is not preserved in this first approach formulation. Hence, the integrality constraints on the decision variables must be enforced. Equation 3 manifests therefore as an integer program, and must be solved using the method of branch-and-bound, rather than the Simplex method. This solution method takes a relatively long time in terms of computation time and can also require a relatively large amount of memory for storage of the decision tree. In particular, obtaining the truly optimal solution (as opposed to a solution within a specified percentage of the optimal solution) may take a relatively long time.

When the aggregated formulation (equation 3) is LP-relaxed and solved in CPLEX, the decision variables may take fractional values, and the outcome is expressed in equation 4 following:

$$\max \sum_i v_i x_i \qquad \text{equation 4}$$

s.t.

$$n_i x_i \leq \sum_{j \in P(i)} x_j$$

$$0 \leq x_i \leq 1 \quad \forall i$$

where $n_i = |P(i)|$

Figure 12:
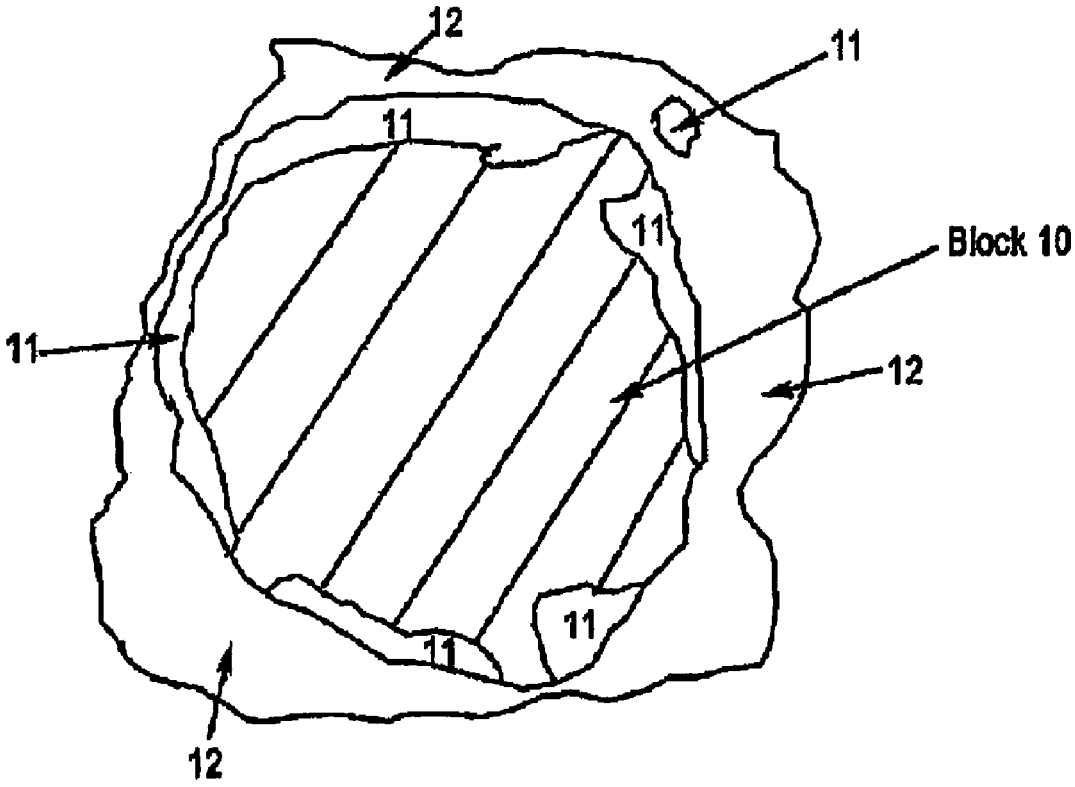
FIG. 12 illustrates a comparison between outcomes of equations 2 and 4.

Consider the case of a relatively small first example of a mine (16,049 blocks) that is provided as an example with the Whittle software package (by Whittle Pty Ltd, www,whittle-.com.au). FIG. 12 shows the view from above of a comparison of the optimal solutions found by the exact formulation (equation 2) and the LP relaxation of the aggregated formulation (equation 4). The blocks 10 are those that are set to 1 by both the exact formulation (equation 2) and the aggregated formulation (equation 3). The blocks 11 around the outside of this pit are those blocks which are included (set to 1) in the ultimate pit found by the exact formulation (equation 2), but are not included (set to 0) in the solution found by the LP relaxation of the aggregated formulation (equation 4). It is evident that there are a number of blocks that are included in the true ultimate pit that are not included by the LP relaxation of the aggregated formulation (equation 4). The blocks 12 are waste.

Figure 13:
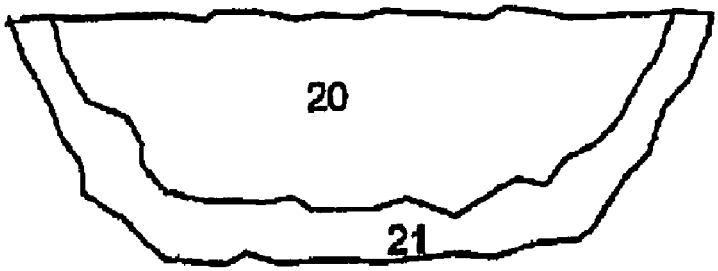
FIG. 13 illustrates a vertical cross-section of a pit design using equation 2.
Figure 14:
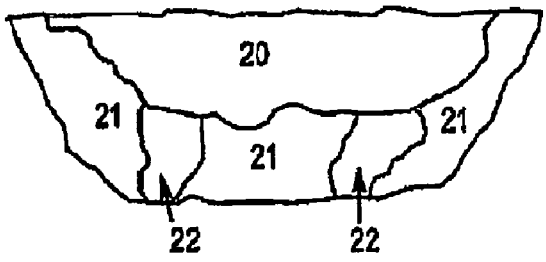
FIG. 14 illustrates a vertical cross-section of a pit design using equation 4.

A comparison of a vertical cross-section of the pit design using the exact formulation (equation 2) and the LP relaxation of the aggregated formulation (equation 4) for this first mine example is illustrated in FIG. 13 when compared with FIG. 14.

FIG. 13 shows a plane through the example pit from the view of the solution using the exact formulation (equation 2). The area 20 is the ultimate pit and the area 21 is waste. Referring to Table 1, below, the total value of this pit is found to be $1.43885E+09, and CPLEX requires 29.042 seconds to obtain this solution.

FIG. 14 shows the equivalent view when the LP relaxation of the aggregated formulation (equation 4) for the ultimate pit is used. The area 20 is blocks set to 1, area 21 is waste (blocks set to 0) and area 22 is material which may be further interrogated in order to decide whether it is included (or not) in the ultimate pit (set to a value between 0 and 1). The total value of this pit is found to be $1.54268E+09, and found in a CPU time of 0.992 seconds. Note that the solution of the aggregated formulation (equation 3) (where integrality constraints are imposed on the decision variables) gives a total value of the ultimate pit to be $1.43591E+09 (using a branch-and-bound stopping criteria of 1% from optimal), which is similar to the value as that given by equation 2, and a CPU time of 1675.18 seconds was required to obtain this solution.

TABLE 1

Summary of results for first mine example.

| First example mine | Total Blocks | 16049 |
|---|---|---|
| Formulation<br>Exact LG (equation 2) | | |
| Total Number of Precedence Constraints | 264859 | |
| Total Value | 1.43885E+09 | |
| CPU Time (Seconds) | 29.402 | |

TABLE 1-continued

Summary of results for first mine example.

| First example mine | Total Blocks | 16049 |
|---|---|---|
| No. Blocks in Ultimate Pit | 9402 | |
| % of Total Blocks | 58.58 | |
| Aggregated LG (equation 3)<br>(IP) | | |
| Total Number of Precedence Constraints | 14077 | |
| Total Value | 1.43591E+09 | |
| CPU Time (Seconds) | 1675.18 | |
| No. Blocks in Ultimate Pit | 9670 | |
| % of Total Blocks | 60.25 | |
| Final Gap (from optimal) | 0.46% | |
| Aggregated LG (equation 4)<br>(LP relaxation) | | |
| Total Number of Precedence Constraints | 14077 | |
| Total Value | 1.54268E+09 | |
| CPU Time (Seconds) | 0.992 | |
| No. Blocks in Ultimate Pit | 7949 | |
| % of Total Blocks | 49.53 | |
| Aggregated LG (Cutting Plane)<br>(equation 9, below)<br>(LP relaxation + add single block constraints) | | |
| Total Number of Precedence Constraints | 34819 | |
| Total Value | 1.43885E+09 | |
| CPU Time (Seconds) | 976.565 | |
| No. Blocks in Ultimate Pit | 9402 | |
| % of Total Blocks | 58.58 | |
| Number of Iterations | 9 | |

It is evident that CPLEX, when using this relaxed aggregated formulation for the problem, provides a relatively higher valued ultimate pit to be found, but does so in a relatively shorter time. This relatively higher value results, in part, from a relaxation of the predecessor constraints, thus allowing a fraction of a block to be taken even when all of its predecessor blocks have not been taken.

Figure 15:
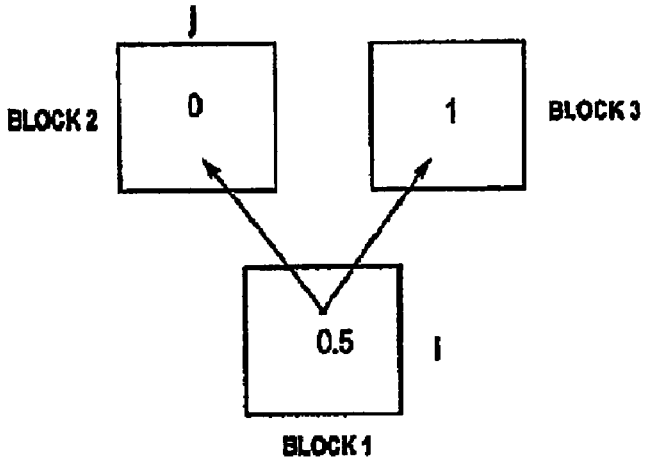
FIG. 15 illustrates an example portion of a pit.

By way of illustration of the reason for finding a relatively higher pit value using equation 4, consider the situation shown in FIG. 15. The number within each block represents the value assigned to the decision variable (xi) for that block by the LP relaxation of the aggregated formulation (equation 4).

In the case illustrated in FIG. 15, Blocks 2 and 3 are predecessors of Block 1. Block 1 is represented by $x_1$, block 2 by $x_2$ and block 3 by $X_3$ in the equations below. In the exact formulation (equation 2), the constraints for this situation illustrated are $$x_1 \leqq x_2$$

$$x_1 \leqq x_3 \qquad \text{equation 5}$$

The solution given (x1=0.5, x2=0, x3=1) is infeasible for the exact formulation (equation 2), since $$x_1 = 0.5 > x_2 = 0$$

However, in the LP relaxation of the aggregated formulation (equation 4), the relevant constraint is $$2x_1 \leqq x_2 + x_3 \qquad \text{equation 7}$$

In this case the solution from FIG. 15 is considered feasible (since 2×0.5=1<=0+1=1).

$$2 \times \frac{1}{2} \leq 0 + 1 \qquad \text{equation 8}$$

Hence if Blocks 1 and 3 were ore blocks and had positive value, while Block 2 was a waste block with negative value, the LP relaxation of the aggregated formulation (equation 4) can take all of Block 3 and 0.5 of Block 1 without incurring the penalty of taking the negative valued Block 2. Hence the aggregated formulation (equation 4) can take fractions of positive blocks that otherwise would not have been taken in the exact formulation (equation 2). This leads to a solution of greater value than in the disaggregated case.

9. Cutting Plane Method

The LP relaxation of the aggregated formulation (equation 4) can be modified to overcome this solution of artificially greater value. The result is equation 9 below, namely:

$$\max \sum_i v_i x_i \qquad \text{equation 9}$$

s.t.

$$n_i x_i \leq \sum_{j \in P(i)} x_j$$

$$0 \leq x_i \leq 1 \quad \forall i$$

where $n_i = |P(i)|$ loop over all arcs

{if i→j, and $x_i > x_j$ in solution, then add the constraint $x_i \leqq x_j$}

This approach as expressed by equation 9 is considered a second aspect of invention termed a 'cutting plane method'. In this second aspect, an initial (reduced) problem is solved to give an upper bound on the optimal value, and then any constraints from the overall (Master) problem that are violated by this solution are added, and the problem is re-solved. This is repeated until substantially no constraints from the Master problem are found to be violated. In this second aspect, the linear program for the aggregated formulation (equation 4) is run and a solution, call it $\hat{x}$ is obtained. Each element of the vector $\hat{x}$ represents the value (possibly fractional) assigned to each block. Within $\hat{x}$ there will be instances of pairs of individual blocks where the constraint that the successor block cannot be taken until the entire predecessor block has been taken (from the exact formulation) is violated. For example, in FIG. 15, the constraint in the exact formulation that block 1 is assigned an i value of 0.5 and j is assigned a value of 0

$$x_1 \leqq x_2 \qquad \text{equation 10}$$

is violated, since x1=0.5 and x2=0.

Thus, in the case of FIG. 15, i has a value greater than j and the constraint is added and the solution re-run. The result will be the violation posed by FIG. 15 as far as blocks 1 and 2, will be removed. Some individual block constraints can be added to the LP relaxation of the aggregated formulation (equation 4) to make it feasible for the ultimate pit problem. It is possible to perform the following iteration.

For each element of $\hat{x}$, compare its value with that of each of its predecessor blocks in turn. Whenever there is a situation where the successor block has a greater value than the predecessor block, add the relative single block constraint to the formulation. For example, in the situation from FIG. 15, the constraint $$x_1 \leqq x_2$$

will be added to the LP relaxation of the aggregated formulation (equation 4). After checking the relationship for all pairs of predecessors, re-solve the problem, subject to the aggregated constraints as well as the added single block precedence constraints. Again, the solution may be infeasible, so the process may have to be repeated. This process should be repeated until the step of checking single block dependencies reveals that substantially no single block precedence relationships are violated. The solution at this point has been found to be the same as the optimal solution, found by solving the exact formulation (equation 2).

It is considered that the number of constraints needed to obtain the solution using this second aspect approach is significantly less than the number used in the disaggregated formulation. Since the initial aggregated solution gives a reasonable approximation to the ultimate pit, it has been found that only a small percentage of the total number of single block precedence constraints for the problem should need to be added to the formulation. In this way, the computational requirement in terms of memory (storage and manipulation of the constraint matrix) to find the optimal solution should be significantly reduced. However, the cost of this approach is that the process of checking and identification of violated constraints will require more time than the prior art method of equation 2. When equation 9 is applied to the first mine example referred to above, this second approach found the total value of the pit to be $1.43885E+09, the same as the solution to the problem using the disaggregated formulation (equation 2). The computation time required to achieve this second approach was 976.565 seconds.

A brief comparison of these two methods for the ultimate pit problem at the first example mine is given in Table 1, above.

10. Aggregation—Cutting Plane and added Blocks and Arc Constraints

It is evident that the trade off between the prior art approach and the approaches of the first and second aspects is time against memory, as illustrated in Table 1, above). The exact formulation (equation 2) finds the optimal solution in 29.402 seconds, while the cutting plane formulation (equation 9) takes 976.565 seconds to find the optimal solution. This is due, in part, to the fact that the cutting plane formulation re-solves a large LP a number of times in the process of solving the problem. In addition, the process of searching through and checking the entire arcs file (which is completed as a part of each iteration) takes a significant amount of time. However, the exact formulation (equation 2) solves a model with 264,859 precedence constraints (requiring a significant amount of memory), compared with 34,819 precedence constraints in the cutting plane formulation (equation 5). This is a decrease of 87%. It is expected that the number of constraints in the model is proportional to the memory required to store and solve the problem, in particular, to perform the inversion on the final constraint matrix once the optimal solution has been found. Thus, advantageously, a solution of the cutting plane formulation (equation 9) may be possible in cases where CPLEX runs out of memory when trying to solve the exact formulation (equation 2).

In a second example mine, which has 38,612 blocks, the same approach was taken to that above, with similar results, as shown in Table 2.

TABLE 2

Summary of results for second mine example.

| Example Mine 2 | Total Blocks | 38612 |
|---|---|---|
| Formulation | | |
| Exact LG (equation 2) | | |
| Total Number of Precedence Constraints | 1045428 | |
| Total Value | 1.87064e+009 | |
| CPU Time (Seconds) | 223.762 | |
| No. Blocks in Ultimate Pit | 33339 | |
| % of Total Blocks | 86.34 | |
| Aggregated LG (Cutting Plane) (equation 9) (LP relaxation + add arc or single block constraints) | | |
| Total Number of Precedence Constraints | 159832 | |
| Total Value | 1.87064E+09 | |
| CPU Time (Seconds) | 12354.3 | |
| No. Blocks in Ultimate Pit | 33339 | |
| % of Total Blocks | 86.34 | |
| Number of Iterations | 6 | |

In particular, referring to Table 2 above, the exact formulation (equation 2) contains 1,045,428 constraints, while the final model following implementation of the cutting plane algorithm (equation 9) requires only 159,832 constraints. However, the cutting plane method (equation 9) takes 12,354.3 seconds to find the solution, while the exact formulation (equation 2) requires 223.762 seconds of CPU time.

Further testing of the alternative mixed integer program approaches to the pit design was carried out on a third mine example, as detailed in Table 3 below. The block model for the third mine example contains 198,917 blocks.

Initially, the exact formulation (equation 2) was trailed. This resulted in CPLEX attempting to solve a linear program with 3,526,057 single block constraints. The size of this constraint matrix caused CPLEX to run out of memory when trying to apply the dual simplex algorithm to solve the problem. Thus, the exact solution to the pit design in the case of this third mine example is unable to be determined by this approach.

The aggregate formulation (equation 3) was next trailed. This resulted in 188,082 constraints, a value of $3.34125E+09, and a CPU time of 33298.5 seconds.

The next trail was to run the LP relaxation of the aggregated formulation (equation 4). It is expected that the solution to this problem will give an upper bound on the optimal value of the ultimate pit, as was described above. This is due to the fact that CPLEX includes fractions of blocks without necessarily taking their entire precedence set. In this trail, the model had 188,082 constraints. The optimal solution was found to have a value of $3.40296E+09, and this was found in 12.989 seconds of CPU time.

TABLE 3

Summary of results for third mine example.

| example Mine 3 | Total Blocks | 198917 |
|---|---|---|
| Exact LG (equation 2) | | |
| Total Number of Precedence Constraints | 3526057 | |
| Total Value | | |

TABLE 3-continued

Summary of results for third mine example.

| example Mine 3 | Total Blocks | 198917 |
|---|---|---|
| CPU Time (Seconds) | out of memory | |
| No. Blocks in Ultimate Pit | | |
| % of Total Blocks | | |
| Aggregated LG (equation 3) (IP) | | |
| Total Number of Precedence Constraints | 188082 | |
| Total Value | 3.34125E+09 | |
| CPU Time (Seconds) | 33298.5 | |
| No. Blocks in Ultimate Pit | 97221 | |
| % of Total Blocks | 48.88 | |
| Final Gap (from optimal) | 0.99% | |
| Aggregated LG (equation 4) (LP relaxation) | | |
| Total Number of Precedence Constraints | 188082 | |
| Total Value | 3.40296E+09 | |
| CPU Time (Seconds) | 12.989 | |
| No. Blocks in Ultimate Pit | 91522 | |
| % of Total Blocks | 46.01 | |
| Aggregated LG (Cutting Plane) (equation 9) (LP relaxation + add single block or arc constraints) | | |
| Total Number of Precedence Constraints | 285598 | |
| Total Value | 3.37223E+09 | |
| CPU Time (Seconds) | 19703.8 | |
| No. Blocks in Ultimate Pit | 98845 | |
| % of Total Blocks | 49.69 | |
| Number of Iterations | 4 | |

The cutting plane formulation (equation 9) was also trailed on this example third mine. This is the method where the solution to the LP relaxation of the aggregated formulation is used as a starting solution, and then violated single block constraints are added to the model and then again resolved. This process is repeated until no more single block constraints are violated, and thus the solution is similar to that for the exact formulation. The solution to this equation 9 is considered to be the correct solution to the problem. When equation 9 was run, it was found that CPLEX was able to handle the size of the problem, and the exact ultimate pit was found. The solution contained 285,598 constraints, a reduction of 92% on the exact formulation. The optimal value of the pit design was found to be $3.37223E+09, and the CPU time required to find this solution was 19703.8 seconds.

Thus the cutting plane algorithm (equation 9) has been found to provide an improved solution within the memory limits of a practical implementation of the present invention, using computers and/or computer modelling, where the exact formulation (equation 2) could not. Again, the saving in memory is offset by a longer computation time.

Figure 16:
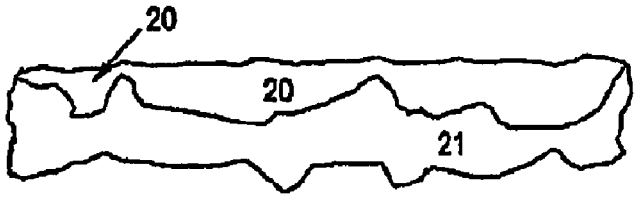
FIGS. 16 and 18 illustrate a plane view through a pit using the cutting plane formulation (equation 9)
Figure 17:
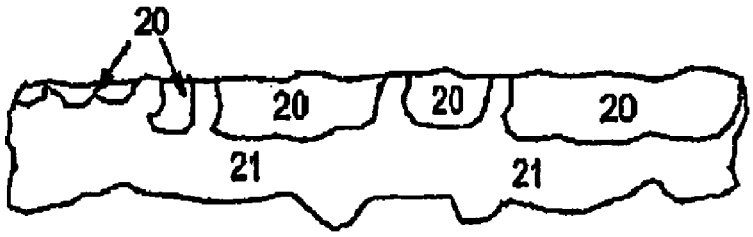
FIGS. 17 and 19 illustrate the same view as that of FIGS. 16 and 18 but for the use of the LP relaxation of the aggregated formulation (equation 4).
Figure 18:
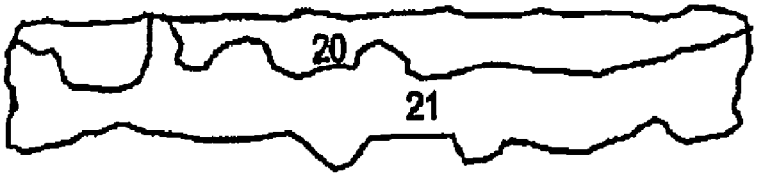
Figure 19:
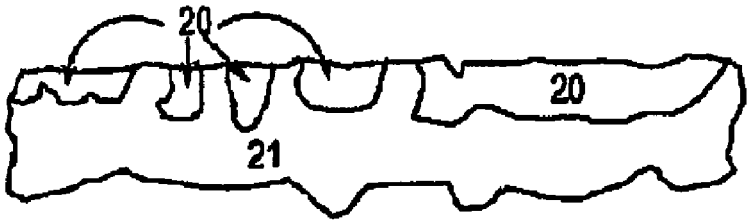

As in the case of the first mine example, a comparison of a vertical cross-section of the solution to the ultimate pit problem using the cutting plane formulation and the LP relaxation of the aggregated formulation for the third mine example is illustrated in the Figures. FIGS. 16 and 18 show a plane view through the pit using the cutting plane formulation (equation 9). The area 20 is the ultimate pit and the area 21 is waste. FIGS. 17 and 19, on the other hand, show the same view, but for the LP relaxation of the aggregated (equation 4). Again, areas 20 are the pit and areas 21 are waste. Again, it is evident that the LP relaxation of the aggregated (equation 4) takes fractions of blocks that are infeasible for the exact formulation.

This result is considered to confirm that solution of the cutting plane formulation (equation 9) may be possible in cases where CPLEX runs out of memory when trying to solve the exact formulation (equation 2).

A summary of the results for the third mine example is found in Table 3.

11. Variations On The Cutting Plane Method 11.1 First Variation

Since it was found that adding all violated constraints at once causes additional loading on the cutting plane approach (equation 9), due to the very large number of constraints added by the first iteration, one variation of the cutting plane method is to add the constraints incrementally. Initially, the effect of adding the most violated constraints first, and then re-solving the formulation was investigated. This method was thoroughly tested on the first mine example. The approach taken was as follows. At each iteration of the method, a lower bound on the size of the violation of the single block constraint was specified (e.g. 0.5, 0.6, . . . ). For example, FIG. 15 illustrates violations for each block. In this example FIG. 15, the violation=xi−xj, and so the 'size' of the violation is 0.5-0=0.5. Constraints that were violated by an amount greater than this tolerance were added to the formulation, and the problem was re-solved. However, using this approach the optimisation process completed before the optimal solution was found. This occurs because this method of adding constraints does not identify and add all single block constraints that are violated, only those that are violated by more than a certain amount. In this way, not all of the necessary single block constraints are added to the formulation, and the truly optimal solution is not reached. To alleviate this problem, violation(s) greater than a selected lower bound is added to at least the first iteration. This approach enables an optimal solution is still obtained.

11.2 Second Variation

Another approach is to add the most violated constraints, but to decrease the amount of violation required at each iteration until a certain number of constraints have been added. For example, it may be designated that a minimum of 5000 constraints should be added at each iteration. Say the initial violation parameter is set to 0.6 (that is, only single block constraints that are violated by 0.6 or more are added to the formulation). It may be the case that 1200 constraints are added. Then, before re-solving the formulation, the violation parameter could be decreased to 0.5. This may result in a further 3000 constraints being added to the model. Since there are still less than 5000 constraints added, the violation parameter is further decreased to 0.4, and more single block constraints are added. This may result in 2000 constraints being added to the formulation, and the problem is now re-solved since the minimum of 5000 constraints has been reached. The process is then repeated until the optimal solution is obtained.

11.3 Third Variation

Alternatively, the tolerance could be reduced on a smaller incremental level (say 0.01 at a time instead of 0.1) in an attempt to reduce the size of the overshoot on the number of constraints added compared with the prescribed minimum number of constraints.

11.4 Fourth Variation

A further alternative is simply to add a specified number of constraints to the model before the formulation is re-solved. In any approach where a minimum number of constraints are added, the determination of the appropriate number of constraints to add at each iteration is a non-trivial matter. This element of the problem may itself require optimisation. It is expected that the maximum size of the problem that is able to be stored in memory and handled by CPLEX will affect this value. Consideration of this fact may allow a test to be built in to the program for solving the ultimate pit problem. The form of the test procedure could proceed as follows. If the size of the constraint matrix following the first iteration is less than the maximum size able to be solved by CPLEX, (with a margin to allow more constraints to be added in subsequent iterations based on the general proportion of constraints added after the initial loop—it appears that approximately 90% of the constraints that are required are added in the first loop), take the path of adding all violated constraints. If the size of the constraint matrix following the first iteration is greater than the maximum able to be solved, restart the iteration process using one of the alternative constraint-adding processes described above.

The approaches described above were tested on the first mine example above. In this case, the approach that performed the best was to add single block constraints that were violated by more than 0.6 in the first 5 loops, and in subsequent loops, add all violated constraints. This approach found the optimal solution in 2152.24 seconds. This was significantly longer than the standard cutting plane procedure, which required 976.565 seconds (compare with statement below).

11.5 Fifth Variation

Another approach for adding constraints incrementally takes advantage of the specific geometry of the mine. In this case, a vector containing the z coordinate (or "height") for each block is stored. Using this information, violated single block constraints are added from the largest z coordinate (corresponding to the top of the pit) down, decreasing by block height, in each loop. The constraint adding process stops either once a specified number of constraints have been added, or after a specified number of z coordinates have been descended. By adding violated single block constraints from the largest z coordinate down, it is hoped that the subsequent optimisation steps will force more single block constraints from lower in the pit to be satisfied before they need to be explicitly added to the formulation in a cutting plane iteration. That is, once decisions regarding the uppermost benches of the pit have been made, the precedence constraints within the formulation could force these decisions to propagate down the pit. Subsequently, less single block constraints may need to be added through the cutting plane iterations before the problem is solved to optimality.

This approach was particularly effective in the case of the third mine example. The optimal solution to the problem was found in 2664.11 seconds when constraints were added from the top z coordinate down in each iteration, with ten z coordinates descended in each iteration. This compares very favourably with the standard cutting plane formulation, which requires 19,703.8 seconds to find the optimal solution.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

The present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

The invention claimed is:

1. A method of determining extraction of material from a mine having at least one pit comprising:

(a) receiving into a data processing system a block model to divide the pit into a plurality of blocks based on predetermined mining parameters;

(b) defining, using the data processing system, a plurality of clusters, each comprising a plurality of blocks;

(c) defining, using the data processing system, a plurality of cones, each containing at least one cluster;

(d) defining, using the data processing system, a plurality of clumps by the intersection of cones and determining a block order extraction schedule from the clumps;

(e) determining, using the data processing system, a secondary clustering of the blocks in the block order extraction schedule, wherein the secondary clustering clusters blocks according to spatial order and block order extraction schedule ordering;

(f) propagating, using the data processing system, second cones upwardly from each secondary cluster of blocks; and (g) ordering, using the data processing system, the extraction of material from each second cone to provide an optimal extraction schedule of all blocks in the pit.

2. The method according to claim 1 further comprising forming a pushback design and analyzing the pushback design for mineability and net present value of mine and if the balance between mineability and net present value of mine is not acceptable, forming a further pushback design, and then repeating steps (e) to (g).

3. The method according to claim 1 wherein the step of defining a plurality of cones comprises defining the cones by precedent arcs extending from each cluster.

4. The method according to claim 1 comprising defining each cluster based on a relationship, the relationship based on a spatial position of blocks relative to one another.

5. The method according to claim 4 comprising further defining each cluster based on time of extraction.

6. The method according to claim 4 comprising further defining each cluster based on a variable selected from the group comprising value of material, grade of material, and material type.

7. The method according to claim 4 wherein clustering is controlled so that clusters are formed from blocks which are more spatially fragmented but more closely follow an optimal extraction schedule.

8. The method according to claim 4 wherein clustering is controlled so the clusters are formed from blocks which are spatially compact but ignore an optimal extraction sequence.

9. The method according to claim 1 wherein when the plurality of clusters has been defined, the clusters are ordered in time and the plurality of cones are propagated upwardly from each cluster in order of time, and wherein any blocks already assigned to a first cone are not included in a second cone or any subsequent cone, and any blocks assigned to the second cone are not included in any subsequent cone and so-on.

10. The method according to claim 1 wherein a size of each cluster is controlled to a predetermined size by reducing oversized clusters by reassigning blocks of that cluster according to their probability of belonging to other clusters.

11. The method according to claim 1 wherein the predetermined mining parameters comprise mining and processing capabilities and slope constraints, the mining parameters being expressed in terms of tonnes per year that may be mined or processed subject to capacity constraints.

12. The method according to claim 1 wherein the block model contains information relating to value of a block in monetary terms, grade of the block, the tonnage of rock in the block, or tonnage of ore in the block.

13. The method of claim 1 wherein after step (d) and before step (e) an optimisation step occurs which calculates an order of extraction of blocks to maximise net value of material to be extracted.

14. An apparatus for determining extraction of material from a mine having at least one pit comprising:

a processor for;

(a) receiving a block model to divide the pit into a plurality of blocks based on predetermined mining parameters;

a memory for storing computer program code that, upon execution by the processor performs operations comprising:

(b) defining a plurality of clusters, each comprising a plurality of blocks;

(c) defining a plurality of cones, each containing at least one cluster;

(d) defining a plurality of clumps by the intersection of cones and determining a block order extraction schedule from the clumps;

(e) determining a secondary clustering of the blocks in the block order extraction schedule, wherein the secondary clustering clusters blocks according to spatial order and block order extraction schedule ordering;

(f) propagating second cones upwardly from each secondary cluster of blocks; and (g) ordering the extraction of material from each second cone to provide an optimal extraction schedule of all blocks in the pit.

15. The apparatus according to claim 14 wherein the memory also forms a pushback design and analyzes the pushback design for mineability and net present value of mine and if the balance between mineability and net present value of mine is not acceptable, forming a further pushback design, and then repeating steps (e) to (g).

16. The apparatus according to claim 14 wherein the step of defining a plurality of cones comprises defining the cones by precedent arcs extending from each cluster.

17. The apparatus according to claim 14 wherein a relationship is used to define each cluster and the relationship is based on a spatial position of blocks relative to one another.

18. The apparatus according to claim 17 wherein the relationship further comprises a time of extraction.

19. The apparatus according to claim 17 wherein the relationship further comprises a variable selected from the group comprising value of material, grade of material, and material type.

20. The apparatus according to claim 17 wherein an emphasis of the relationship is controlled so that clusters are formed from blocks which are more spatially fragmented but more closely follow an optimal extraction schedule.

21. The apparatus according to claim 17 wherein an emphasis of the relationship is controlled so that clusters are formed from blocks which are spatially compact but ignore an optimal extraction sequence.

22. The apparatus according to claim 14 wherein when the plurality of clusters has been defined, the clusters are ordered in time and the plurality of cones are propagated upwardly from each cluster in order of time, and wherein any blocks already assigned to a first cone are not included in a second cone or any subsequent cone, and any blocks assigned to the second cone are not included in any subsequent cone and so-on.

23. The apparatus according to claim 14 wherein a size of each cluster is controlled to a predetermined size by reducing oversized clusters by reassigning blocks of that cluster according to their probability of belonging to other clusters.

24. The apparatus according to claim 14 wherein the predetermined mining parameters comprise mining and processing capabilities and slope constraints, the mining parameters being expressed in terms of tonnes per year that may be mined or processed subject to capacity constraints.

25. The apparatus according to claim 14 wherein the block model contains information relating to value of a block in monetary terms, grade of the block, tonnage of rock in the block, and tonnage of ore in the block.

26. The apparatus of claim 14 wherein, after step (d) and before step (e), the memory performs an optimisation step which calculates an order of extraction of blocks to maximise net value of material to be extracted.

27. A non-transitory computer readable medium having stored thereon computer program code which when executed by a processor determines extraction of material from a mine having at least one pit, the computer program code comprising:

(a) code for using a block model to divide the pit into a plurality of blocks based on predetermined mining parameters;

(b) code for defining a plurality of clusters, each comprising a plurality of blocks;

(c) code for defining a plurality of cones, each containing at least one cluster;

(d) code for defining a plurality of clumps by the intersection of cones and determining a block order extraction schedule from the clumps;

(e) code for determining a secondary clustering of the blocks in the block order extraction schedule, wherein the secondary clustering includes clustering blocks according to spatial order and block order extraction schedule ordering;

(f) code for propagating second cones upwardly from each secondary cluster of blocks; and (g) code for ordering the extraction of material from each second cone to provide an optimal extraction schedule of all blocks in the pit.

28. The program according to claim 27 wherein code (d) further comprises code for forming a pushback design and analysing the pushback design for mineability and net present value of mine and if the balance between mineability and net present value of mine is not acceptable, forming a further pushback design.

29. The program according to claim 27 wherein the code for defining a plurality of cones comprises defining the cones by precedent arcs extending from each cluster.

30. The program according to claim 27 wherein the code for defining the plurality of clusters comprises use of a relationship that includes a spatial position of blocks relative to one another.

31. The program according to claim 30 wherein the relationship further comprises a time of extraction.

32. The program according to claim 30 wherein the relationship further comprises a variable selected from the group comprising value of material, grade of material, and material type.

33. The program according to claim 30 further comprising code for forming clusters from blocks which are more spatially fragmented but more closely follow an optimal extraction schedule when an emphasis of the relationship is controlled.

34. The program according to claim 30 further comprising code for forming clusters from blocks which are spatially compact but ignore an optimal extraction sequence when an emphasis of the predetermined relationship is controlled.

35. The program according to claim 27 wherein when the plurality of clusters has been defined, the clusters are ordered in time and the plurality of cones are propagated upwardly from each cluster in order of time, and wherein any blocks already assigned to a first cone are not included in a second cone or any subsequent cone, and any blocks assigned to the second cone are not included in any subsequent cone and so-on.

36. The program according to claim 27 wherein the size of each cluster is controlled to a predetermined size by reducing oversized clusters by reassigning blocks of that cluster according to their probability of belonging to other clusters.

37. The program according to claim 27 wherein the predetermined mining parameters comprise mining and processing capabilities and slope constraints, the mining and processing parameters being expressed in terms of tonnes per year that may be mined or processed subject to capacity constraints.

38. The program according to claim 27 wherein the block model contains information relating to value of a block in monetary terms, grade of the block, tonnage of rock in the block, and tonnage of ore in the block.

39. The program of claim 27 further comprising code for performing an optimisation step which calculates an order of extraction of blocks to maximise net value of material to be extracted.

* * * * *